US005932359A

United States Patent [19]

Nagai et al.

[11] Patent Number: 5,932,359

[45] Date of Patent: Aug. 3, 1999

[54] SURFACE-TREATED STEEL SHEET FOR FUEL TANKS

[75] Inventors: Hiroyuki Nagai; Yoshihiro Kawanishi; Eiji Kajiyama; Hiroyuki Kashiwagi; Shinichi Tsuchiya, all of Ibaraki, Japan

[73] Assignee: Sumitomo Metal Industries, Ltd., Osaka, Japan

[21] Appl. No.: 08/687,520

[22] PCT Filed: Dec. 8, 1995

[86] PCT No.: PCT/JP95/02516

§ 371 Date: Nov. 4, 1996

§ 102(e) Date: Nov. 4, 1996

[87] PCT Pub. No.: WO96/17979

PCT Pub. Date: Jun. 13, 1996

[30] Foreign Application Priority Data

Dec. 8, 1994 [JP] Japan ..... 6-305125
Jun. 16, 1995 [JP] Japan ..... 7-150394

[51] Int. Cl.[6] ..... B21D 39/00

[52] U.S. Cl. ..... 428/621; 428/632; 428/658; 428/659; 428/681

[58] Field of Search ..... 428/658, 680, 428/681, 638, 659, 621, 632

[56] References Cited

U.S. PATENT DOCUMENTS 4,548,868 10/1985 Yonezawa et al. ..... 428/446
4,707,415 11/1987 Ikeda et al. ..... 428/621
4,940,639 7/1990 Ohshima et al. ..... 428/659
5,330,850 7/1994 Suzuki et al. ..... 428/623
5,422,192 6/1995 Takahashi et al. ..... 428/632

FOREIGN PATENT DOCUMENTS 58-45396 3/1983 Japan .

*Primary Examiner*—Paul Thibodeau
*Assistant Examiner*—Holly C. Rickman
*Attorney, Agent, or Firm*—Burns, Doane, Swecker & Mathis, LLP

[57] ABSTRACT

A surface-treated steel sheet for fuel tanks comprising a Zn—X alloy plating layer + a chromate film, in which the Zn—X alloy plating layer has an X content for the plating metal as a whole of Ni: 9–18 wt %, Co: 0.02–3 wt %, Mn: 25–45 wt %, or Cr: 8–20 wt %, the amount of deposition of the plating layer is 5–40 g/m$^2$ and the amount of the chromate film is 10–200 mg/m$^2$ on a metallic Cr basis, the Zn—X alloy plating layer corresponding to at least the inner surface of a tank has: (1) cracks in the surface layer, with the density of the cracks being 1000–150000 in terms of the number of plated regions surrounded by cracks in a visual field of 1 mm×1 mm, and the maximum width of the cracks is not more than 0.5 $\mu$m, or (2) an X/(X+Zn) atomic percentage ($X_2$) determined by surface analysis based on ESCA with $X_1 \neq X_2$ (wherein $X_1$=average value of the X content of the plating metal as a whole), and with $X_2$ being Ni: 5–25 at %, Co: 0.009–10 at %, Mn: 15–65 at % or Cr: 5–25 at %.

24 Claims, 28 Drawing Sheets

SURFACE-TREATED STEEL SHEET FOR FUEL TANKS

TECHNICAL FIELD

The present invention relates to a material for fuel tanks, and more particularly to a surface treated steel sheet which exhibits a high level of resistance to corrosion caused by fuels such as gasoline and gasohol and which is suitable for making fuel tanks of vehicles such as automobiles and motorcycles.

BACKGROUND ART

A material for fuel tanks of automobiles and motorcycles is required to have not only weldability but also resistance to general corrosion on the outer side (hereinafter called "cosmetic corrosion resistance") and to corrosion caused by fuels such as gasoline on the inner side (hereinafter called "fuel corrosion resistance"). Conventionally, a ternesheet (10–25% Sn—Pb alloy-plated steel sheet) has widely been used as a material for fuel tanks. However, it has the following disadvantages: (i) Pb included in the ternesheet is harmful to the human body, (ii) the plated layer is easily dissolved in oxides of alcohols, and (iii) formation of pin holes in the plated layer is inevitable, resulting in preferential corrosion of iron from these pin holes since iron is electrochemically base compared with the plated layer, so perforation corrosion resistance is not satisfactory. An alternative to ternesheet, therefore, has long been sought.

Recently, in order to reduce the environmental problems caused by exhaust gases, an alcohol-containing fuel, called "gasohol", is being used increasingly in some countries. Gasohol is a mixture of gasoline and alcohol. For example, the mixture referred to as M15 contains about 15% of methanol, and that referred to as M85 contains about 85% of methanol. Conventional terneplate is easily corroded by such an alcoholic fuel, so a material which can exhibit improved resistance to corrosion caused by an alcohol-containing fuel is strongly desired.

For this purpose, it has been proposed to apply a Zn—Ni alloy electroplated steel sheet to fuel tanks because of its marked resistance to corrosion and its material cost. Prior art references in this respect are as follows.

Japanese Patent Application Laid-Open Specification No. 45396/1983 discloses a surface-treated steel sheet for fuel tanks having a Zn—Ni alloy plating with an Ni content of 5–50 wt % and a thickness of 0.5–20 $\mu$m, and a chromate film on the Zn—Ni alloy plating.

Japanese Patent Application Laid-Open Specification No. 106058/1993 discloses a surface-treated steel sheet for fuel tanks having a Zn—Ni alloy plating with an Ni content of 8–20 wt % and a weight of 10–60 g/m$^2$ and a chromate film on the plating.

These surface-treated steel sheets are excellent with respect to cosmetic corrosion, but they are not adequate with respect to fuel corrosion resistance. Especially, fuel corrosion easily occurs under severe corrosive circumstances, e.g., when the plates are exposed to alcohol-containing fuels contaminated with salt water. However, if a chromate film or electroplated layer is thickened so as to further strengthen protection of the tank from fuel corrosion, weldability is inevitably degraded. Weldability is an essential characteristic for materials for fuel tanks.

A dual-plated steel, such as a steel sheet having a Zn—Ni alloy plating layer and an Ni plating layer placed thereon, which is shown in Japanese Patent Application Laid-Open Specification No. 27587/1987, has also been considered, but this type of plate requires additional production steps and is costly.

DISCLOSURE OF INVENTION

An object of the present invention is to develop a technology which can solve prior art problems relating to a surface-treated steel sheet having a Zn—Ni alloy plating layer+chromate film, and which can improve fuel corrosion resistance, i.e., resistance to corrosion caused by an alcohol-containing fuel of such a sheet without a degradation in weldability and without an addition to costs.

The inventors of the present invention, with an aim to achieve such an object, carried out an investigation and discovered that fuel corrosion resistance is markedly improved when electroplated specimens are kept in an electroplating solution for a short time without application of an electric current after finishing electroplating in the continuous process of Zn—X alloy (X=Ni, Co, Mn, Cr, etc., hereafter collectively referred to as "X") electroplating in an acidic electroplating solution. While examining the cause of such improvement in corrosion resistance, the inventors found that cracks are formed in the Zn—X alloy layer while the electrodeposited sheet is immersed in the acid electroplating solution, and the presence of such cracks in the electroplating layer can improve the fuel corrosion resistance when the density and maximum width of the cracks are within specific ranges.

The inventors carried out further investigations and found that the uppermost surface layer has a higher or lower content of X than the average over the whole plated layer when the Zn—X alloy electroplated steel sheet is immersed in an acidic electroplating solution, and that thickening of X or Zn in the uppermost layer can markedly improve fuel corrosion resistance, especially resistance to corrosion caused by alcohol-containing fuel. This means that the presence of such a Zn—X alloy plating in the surface layer can improve fuel corrosion resistance.

Based on these findings, the inventors completed the present invention with the following first and second aspects.

First Aspect

A surface-treated steel sheet for fuel tanks comprises a Zn—X alloy plating layer on both sides and a chromate film on at least one side corresponding to an inner surface of a fuel tank. The Zn—X alloy plating layer has an X content for the plating metal as a whole of Ni: 9–18 wt %, Co: 0.02–3 wt %, Mn: 25–45 wt %, or Cr: 8–20 wt %. The amount of deposition of the plating layer is 5–40 g/m$^2$ on each side and the amount of the chromate film is 10–200 mg/m$^2$ on a metallic Cr basis. The Zn—X alloy plating layer corresponding to at least the inner surface of a tank has cracks in the surface layer, with the density of the cracks being 1000–150000 in terms of the number of plated regions surrounded by cracks in a visual field of 1 mm×1 mm. The maximum width of the cracks is not more than 0.5 $\mu$m.

Second Aspect

A surface-treated steel sheet for fuel tanks comprises a Zn—X alloy plating layer on both sides and a chromate film on at least one side corresponding to an inner surface of a fuel tank. The Zn—X alloy plating layer has an X content for the plating metal as a whole of Ni: 9–18 wt %, Co: 0.02–3 wt %, Mn: 25–45 wt %, or Cr: 8–20 wt %. The amount of deposition of the plating layer is 5–40 g/m$^2$ on each side and the amount of the chromate film is 10–200 mg/m$^2$ on a metallic Cr basis. The uppermost surface layer of the Zn—Ni alloy plating layer corresponding to at least the inner surface of a tank has an X/(X+Zn) atomic percentage ($X_2$) determined by surface analysis based on ESCA with $X_1 \neq X_2$ (wherein $X_1$=average value of the X content of the plating metal as a whole), with $X_2$ being Ni: 5–25 at %, Co: 0.009–10 at %, Mn: 15–65 at % or Cr: 5–25 at %.

BEST MODE FOR CARRYING OUT THE INVENTION

In either of the before-mentioned first and second aspects of the present invention, a plated steel sheet used as a starting material is a steel sheet comprising an electroplated Zn—X alloy (X=Ni, Co, Mn, or Cr) layer on both sides with the amount of deposition of the plating layer being 5–40 g/m$^2$ on each side, wherein the Zn—X alloy plating layer has an X content for the plating metal as a whole of Ni: 9–18 wt %, Co: 0.02–3 wt %, Mn: 25–45 wt %, or Cr: 8–20 wt %.

The expression "X content for the plating metal as a whole" means the X content on the average over the whole plating layer not just after electroplating of the Zn—X alloy, but after formation of cracks in the first aspect, or after thickening treatment of the surface layer in the second aspect. Such an X content can be determined based on the amounts of Zn and X, which are determined by analyzing a hydrochloric acid solution dissolving the Zn—X alloy plating layer.

When the X content is below the above-defined range for each of the alloying elements, cosmetic corrosion resistance and fuel corrosion resistance are not satisfactory. On the other hand, when the X content is higher than the above-defined range for each of the alloying elements, formability and cosmetic corrosion resistance are not satisfactory. In the case of Ni as X, the content thereof is preferably 10–14 wt %, and more preferably 11–13 wt %.

When the amount of deposition (unless otherwise indicated, the amount of deposition on one side) is smaller than 5 g/m$^2$, the corrosion resistance on the inner and outer sides is not satisfactory. On the other hand, when the amount is larger than 40 g/m$^2$, the improvement in properties is saturated and economy becomes poor, and moreover, weldability is degraded. Preferably the amount of deposition is 7–30 g/m$^2$, and more preferably it is 10–25 g/m$^2$.

According to the first aspect, by means of forming cracks with a density of 1000–150,000 cracks/mm$^2$ at least on one surface of the Zn—X alloy plating layer corresponding to the inner side of a tank and placing a chromate film on the plating layer, fuel corrosion resistance can be drastically improved. Although the reason for this improvement is not completely clear, it is supposed that the corrosion resistance is improved as a whole by an anchoring effect of a chromate film which penetrates into cracks to fix the chromate film firmly, by an increase in the surface area covered with the chromate film due to the presence of cracks, and by a decrease in the number of newly-occurring cracks during press forming due to pre-formation of cracks and covering of these cracks with a chromate film. In this respect, under usual conditions, when the Zn—X alloy plated steel sheet of the crack-free type is subjected to press forming, cracks are newly formed, and the substrate sheet is exposed to air, resulting in degradation in corrosion resistance.

Figure 1:
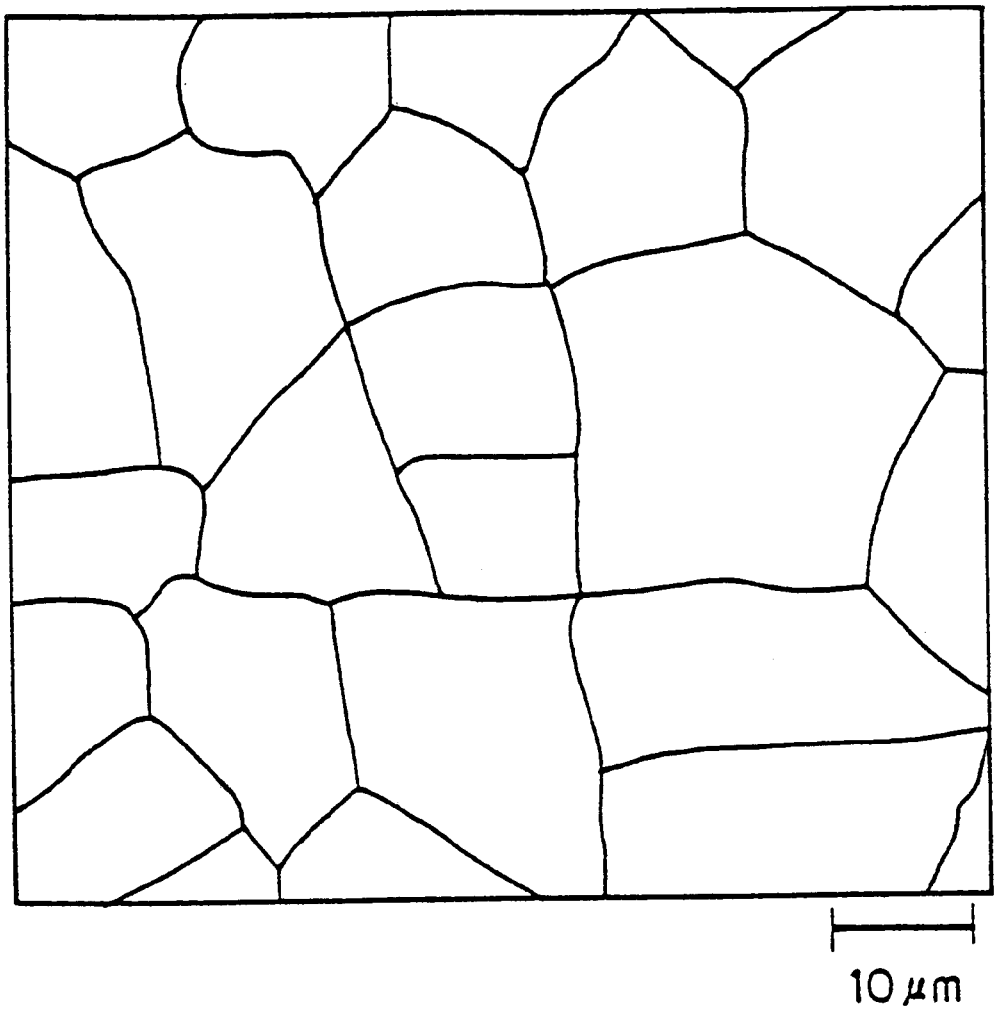
FIG. 1 is a schematic illustration drawn on the basis of an SEM photograph of cracks formed in the surface of a Zn—X alloy plating layer.

In the present invention, the density of cracks is defined by the number of areas surrounded by cracks in a visual field measuring 1 mm×1 mm on the surface of the plating layer. Measurement of the crack density is carried out by randomly taking 30 SEM (scanning electron microscope) photographs of a surface of the plating layer of a specimen at a magnification of 1000 and counting the number of areas surrounded by cracks in a randomly set visual field measuring 0.1 mm×0.1 mm for each of the photographs by means of image processing. The average number of cracks is determined for all 30 photographs, and the average is multiplied by 100 to obtain a crack density. An "area surrounded by cracks" is, as schematically illustrated in FIG. 1 which is based on an SEM photograph, an area isolated like an island by cracks.

According to the first aspect, resistance to corrosion caused by gasoline or gasohol, i.e., fuel corrosion resistance can be drastically improved by producing cracks in the surface of a Zn—X alloy plating layer with a density of 1000–150,000 cracks/mm$^2$ as determined in the manner above. When the crack density is larger than 150,000 cracks/mm$^2$, too many cracks are produced, and the substrate surface covered with the plating layer, i.e., the covering area, is decreased too much, inevitably resulting in a degradation in fuel corrosion resistance. On the other hand, when the crack density is smaller than 1000 cracks/mm$^2$, there is almost no improvement in fuel corrosion resistance.

The maximum width of cracks is 0.5 $\mu$m or less. The maximum width of cracks can be determined by measuring the crack width of the largest crack among cracks found in a visual view of 0.1 mm×0.1 mm on all 30 SEM photographs. When the maximum width is over 0.5 $\mu$m, the shielding effect of a plating layer is impaired, resulting in a degradation in both cosmetic corrosion resistance and fuel corrosion resistance.

Preferably, the crack density is in the range of 1000–50000 cracks/mm$^2$, and the maximum crack width is 0.4 $\mu$m or less.

There is no restriction on how to produce these cracks in the surface of a Zn—X alloy plating layer. Mechanical methods of applying plastic deformation, such as bending after plating or stretching after plating, are possible. Chemical methods, such as etching with an acid or alkali aqueous solution, are preferred, since it is possible to control the crack density and to produce uniform cracks more easily by chemical methods.

When the electroplating of a Zn—X alloy is carried out using an acidic plating solution (e.g., a sulfate bath), the acidic plating solution can also be used in etching. Namely, as described before, after completing electroplating of a steel sheet with a Zn—X alloy in an acidic bath, application of an electric current is stopped while the steel sheet is kept immersed in the plating bath so as to carry out etching of the plating surface to form cracks. Thus, without using a separate tank or an acidic or alkaline aqueous solution which is prepared separately, it is possible to carry out etching to form the necessary amount of cracks in the surface of the plating layer using a conventional plating apparatus and a conventional plating solution as they are. Thus, it is possible to efficiently produce a surface-treated steel sheet according to the first aspect of the present invention at lower costs without additional processing steps. Also, by using a separate tank annexed to a plating bath, immersion into the plating solution can be performed.

According to the second aspect, by preparing the uppermost surface layer of the Zn—X alloy plating layer on at least one side corresponding to an inner surface of a tank having an X/(X+Zn) atomic percentage ($X_2$) determined by surface analysis based on ESCA with $X_1 \neq X_2$ (wherein $X_1$: average value of the X content of the plating metal as a whole) and with $X_2$ being Ni: 5–25 at %, Co: 0.009–10 at %, Mn: 15–65 at % or Cr: 5–25 at % so that the X content of the Zn—X alloy in the uppermost layer is made larger or smaller than the average over the entire plating layer, and by placing a chromate film on the plating layer, fuel corrosion resistance can drastically be improved as in the first aspect. Although the reason for this improvement is not completely clear, it is supposed that element X is resistant to corrosion, and the thickening of element X or Zn in the uppermost surface of a plating layer strengthens the resistance to corrosion.

By means of ESCA (Electron Spectroscopy for Chemical Analysis) it is possible to analyze a surface layer to an emitting depth of photoelectrons, usually to a depth of several nanometers (nm) from the surface. When the value $X_2$ in atomic percentage (=X/(X+Zn), which is determined by this method, is lower than the above-defined range for X, the improvement in fuel corrosion resistance is inadequate. On the other hand, when the value $X_2$ is higher than the above range, removal of Zn from the plating layer occurs excessively, and the cracks formed in the surface are so large that fuel corrosion resistance is rather impaired. Preferably, the percentage $X_2$ is Ni: 5–21 at %, Co: 0.01–4 at %, Mn: 15–55 at %, Cr: 5–24 at %.

In order to increase or decrease the X content in the surface area of a Zn—X alloy plating layer it is advisable to perform an etching process on a plating layer using an acid or alkali aqueous solution so that Zn is dissolved in the solution preferentially. As described with respect to the first aspect, an acidic plating solution can also be used in etching, and after completing electroplating of a steel sheet with a Zn—X alloy in an acidic bath, application of an electric current is stopped while the steel sheet is kept immersed in the plating bath so as to carry out etching of the plating surface.

As is apparent from the explanation above, a surface-treated steel sheet according to both the first and the second aspects can be produced, in preferred embodiments, by carrying out etching, preferably in an acidic plating solution, after completing Zn—X alloy plating. The necessary amount of deposition and the overall X content of the plating layer may be the same for both the two aspects. According to the first aspect, by means of restricting the crack density and the maximum crack width (hereunder called "condition-1"), and according to the second aspect, by means of restricting the X content in the uppermost surface layer, i.e., the degree of thickening of X or Zn (hereunder called "condition-2"), the fuel corrosion resistance on the inner side of a tank can be ensured. It is to be noted that according to the present invention either one of condition-1 and condition-2 satisfies the before-mentioned requirements of the present invention, and there is no need for both conditions to satisfy the above requirements.

After preparing a steel sheet having a Zn—X alloy electrodeposited layer on both sides, the Zn—X alloy plating layer on the side corresponding to the inner side of a tank is, preferably, immersed in an acidic plating solution to form cracks as defined in the first aspect, or to increase the X content in the uppermost surface as defined in the second aspect. In this respect, it is preferable that the plating layer corresponding to the outer side of a tank also be treated in the same way as described above to form cracks or to thicken the X content of the uppermost surface plating layer like the other side corresponding to the inner side of the tank. Thus, not only the fuel corrosion resistance of the inner side of a tank but also the corrosion resistance of the outer side of a tank are improved markedly. From a practical viewpoint, since it is rather complicated for only one side of a plated steel sheet to be subjected to etching by means of immersion in an acidic plating solution, it is advantageous to apply the etching to both sides of the sheet in view of manufacturing convenience.

After a Zn—X alloy plating layer is provided in accordance with the first or second aspect, chromate treatment is performed on the layer to form a chromate film on the plating layer on the side corresponding to the inner side of a tank, which side is used without being coated with paint. For most fuel tanks, the outer side is coated with paint, and the presence of a corrosion resistant Zn—X alloy plating layer is sufficient. However, when such an outer side is further coated with a chromate film, the cosmetic corrosion resistance is also drastically improved. Chromate treatment on the outer side is, therefore, advisable.

According to the present invention, a chromate film is provided on a plating layer at least on a side corresponding to the inner side of a tank in an amount of 10–200 mg/m$^2$ on a metallic Cr basis. When the amount of a chromate film is smaller than 10 mg/m$^2$, a satisfactory level of corrosion is not established on the inner side of a tank. On the other hand, when the amount is larger than 200 mg/m$^2$, weldability, such as seam welding properties is deteriorated. A preferred amount of a chromate film on the inner side is 50–180 mg/m$^2$ on a metallic Cr basis.

The chromate film may be of the coating type, electrolysis type, or reaction type. When a large amount of $Cr^{+6}$ is contained in a chromate film, since $Cr^{+6}$ is hygroscopic, water contained in fuel is adsorbed and fixed on the surface of the chromate film, and the surface area on hich the water is fixed undergoes severe local corrosion. It is desirable that the content of $Cr+^{6}$ of the chromate film be decreased to as low a level as possible. In this respect, it is preferable to restrict the content of $Cr^{+6}$ to 5% or less with respect to the total Cr content.

According to another preferred embodiment, in order to further strengthen the corrosion resistance of the chromate film, silica is added to the film in an amount such that the weight ratio of $SiO_2$/Cr is 1.0–10.0. When the weight ratio is smaller than 1.0, no further improvement in corrosion resistance of the chromate film is expected. In contrast, when the ratio is over 10.0, a chromate solution is unstable, sometimes resulting in problems in manufacturing operations. Formability of the film is also impaired. Preferably, the ratio of $SiO_2$/Cr by weight is 1.5–9.5.

Silica used in the present invention includes dry silica (gas phase silica or fumed silica), and wet silica (colloidal silica or silica sol). Dry silica, which is less hygroscopic, is preferred to wet silica. When a chromate film contains silica, the amount of the chromate film based on metallic Cr is the same as in the above.

As described before, compared to the inner side of a tank where a paint coating is not applied, the outer side of a tank where a paint coating is applied does not need as much corrosion resistance, and the need to further improve corrosion resistance by applying a chromate film to the outer side is rather small. The amount of a chromate film on the outer side can be reduced to a smaller level than on the inner side without reducing corrosion resistant properties. Although introducing a difference in thickness of a chromate film between the inner and outer side makes chromate treatment complicated, the seam weldability can be improved markedly. This is because seam welding is applied to an assembly where an inner side of a tank contacts an inner side of the tank while electrodes contact each of the outer sides of the tank. If the electrode side of a sheet has a thin chromate film, the electrode is free from contamination from the chromate film. On the other hand, if the contact surfaces have a thick chromate film, the electric resistance at the interface increases resulting in an improvement in bonding. A preferred amount of a chromate film on the outer side of a tank for weldability is 10–100 mg/m$^2$, and more preferably 10–50 mg/m$^2$ on a metallic Cr basis.

EXAMPLE

The present invention will be described in more detail in conjunction with working examples in which "%" means % by weight unless otherwise indicated.

Example 1

Preparation of Samples of Surface-Treated Steel sheet

A cold-rolled steel sheet corresponding to JIS SPCE and having a thickness of 0.8 mm was electroplated with a Zn—X alloy on both sides of the sheet using a sulfate bath under conditions described below to form a Zn—X alloy plated steel sheet. After electroplating was finished, plating layers on both sides of the plated steel sheet were subjected to etching using the same electroplating sulfate bath by immersing the sheet in the acidic plating solution to introduce cracks to the surface of the Zn—X plating layer. The crack density as well as the maximum crack width were varied by adjusting the immersion time in the electroplating solution. In a case in which a Zn—X alloy plating layer having a lower crack density and a larger maximum crack width was required, biaxial stretching was applied to the plated steel sheet after etching. The cracking density and maximum crack width of the cracks in the surface of the plating layer after etching were determined on the basis of SEM photographs, and the average X content over the plating layer, i.e., the X content of the plating layer was also determined in the manner mentioned before.

(Zn—X Alloy Electroplating Conditions)

Plating bath composition: X (sulfate) 0.07–1.1 mol/L

Zn ($ZnSO_4$) 0.4–0.8 mol/L

Na ($Na_2SO_4$) 1 mol/L pH 1.5–2.0 (Sulfuric acid added)

Plating conditions: Bath temperature 45–50° C.

Current density 50–100 A/dm$^2$

Flow rate 0.06–1.40 m/s

After cracks were formed in the surface of a plating layer on both sides of a Zn—X alloy plated steel sheet by etching, a chromate solution of the coating type having the below-mentioned composition was applied to both surfaces with a roll coater, and the chromate coating was baked at 150–300° C. to form a chromate film. Thus, the surface-treated steel sheet according to the first aspect was produced. When roll coating is employed, it is possible to control an amount of chromate coating on each side separately. In the case of samples for a seam welding test, therefore, samples having different amounts of a chromate film on each of the inner and outer sides of the sample were prepared. As silica, dry silica having an average primary particle diameter of 7 nm (tradename "Aerosil 200") was used. For some of the samples, wet silica having an average primary particle diameter of 10 nm (tradename "Snowtex 0") was used.

Composition of chromate treatment solution $Cr^{3+}$10–50 g/L $Cr^{6+}$10–50 g/L $SiO_2$ 0–170 g/L The thus-prepared surface-treated steel sheets were evaluated for fuel corrosion resistance against gasoline and alcohol-containing fuel, cosmetic corrosion resistance, and weldability as described below. Test results are shown by graphs in FIGS. 2 through 9.

Test Procedures

Fuel Corrosion Resistance

Blanks of the surface-treated steel sheet were deep drawn into cylinders to form cups under the following conditions, and 30 ml each of gasoline (◆, ●, ▲, ■) or gasohol (◇, ○, Δ, □) having the below-described compositions was poured into the cups, respectively. After sealing the cups were allowed to stand for 180 days. The maximum penetration depth (mm) on the inner wall was determined to evaluate fuel corrosion resistance.

Cup Drawing Conditions

Blank diameter: 100 mm

Punch diameter: 50 mm

Punch shoulder: 5R

Die diameter: 51 mm

Die shoulder: 5R

BH pressure: 10 KN

Bulged height: 30 mm

Surface roughness: #1200 grinding

Fuel Compositions

Gasoline: Regular gasoline 95%

5% NaCl aqueous solution 5%

Gasohol M15: Regular gasoline 84%

Aggressive methanol 15%

Distilled Water 1%

(note) Aggressive methanol is a mixture of 95% of anhydrous methanol+5% of an aqueous solution containing 0.1% NaCl, 0.08% $Na_2SO_4$, and 10% formic acid.

Cosmetic Corrosion Resistance

Cup drawing of surface-treated steel sheets into cylinders was repeated under the same conditions as in the fuel corrosion resistance test except that the bulged height was changed to 25 mm. After shaping, the edge portion of each specimen was sealed. The outer surface of each of the resulting specimens was subjected to SST (salt spray test) for 1000 hours according to JIS Z 2371. Cosmetic corrosion resistance was evaluated in terms of the maximum depth of penetration after 1000 hours of SST.

Weldability

Continuous seam welding was carried out for 100 m under the following conditions. After welding, the microstructure of a section of a welding portion was observed to classify the weldability into one of the following grades.

Seam Welding Conditions

Welding force: 300 kgf

Current-on time: 3 cycles

Current-off time: 2 cycles

Current: 13000 A (Zn—X alloy electrodeposited steel sheet of the present invention)

14500 A (Ternesheet of Comparative Example)

Welding speed: 2.5 m/min

Classification of weldability

○: Good welding

Δ: Blow holes existing

X: Not welded portions existing

FIG. 2 through FIG. 9 were obtained under the following test procedures.

FIG. 2

Figure 2:
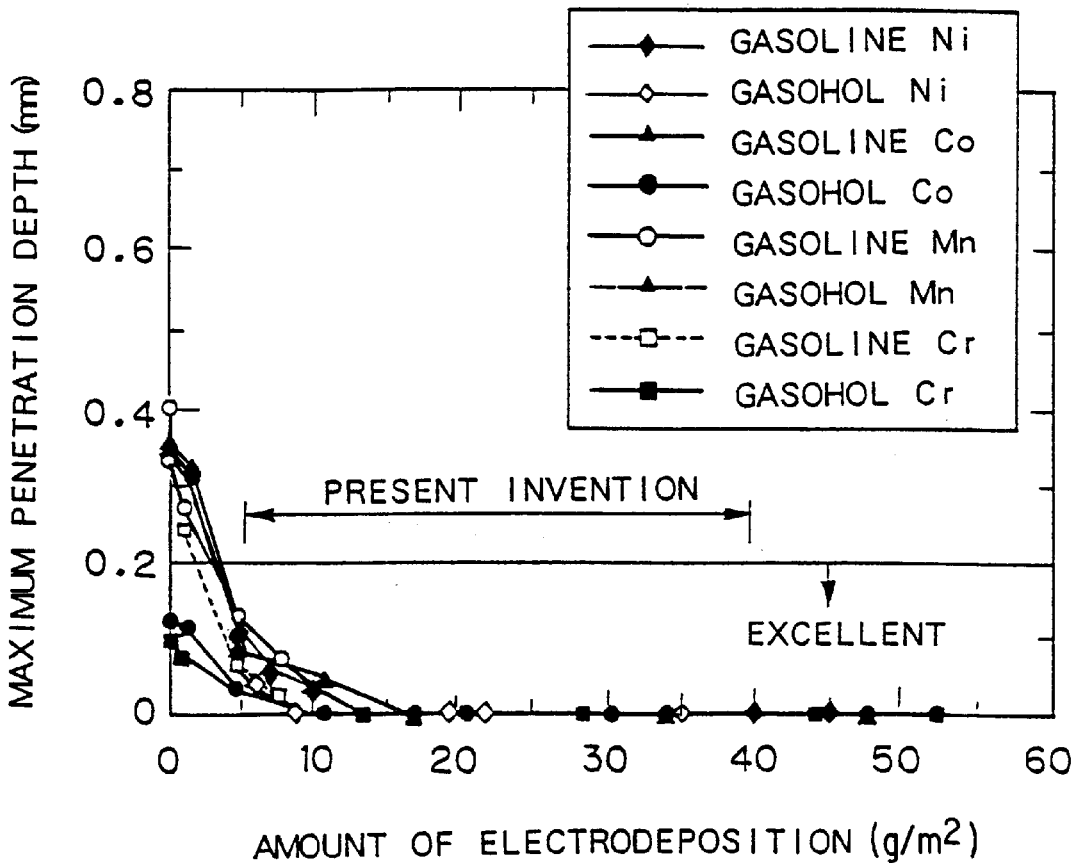
FIG. 2 is a graph showing the effect of the amount of electrodeposition on fuel corrosion resistance.
Figure 3A:
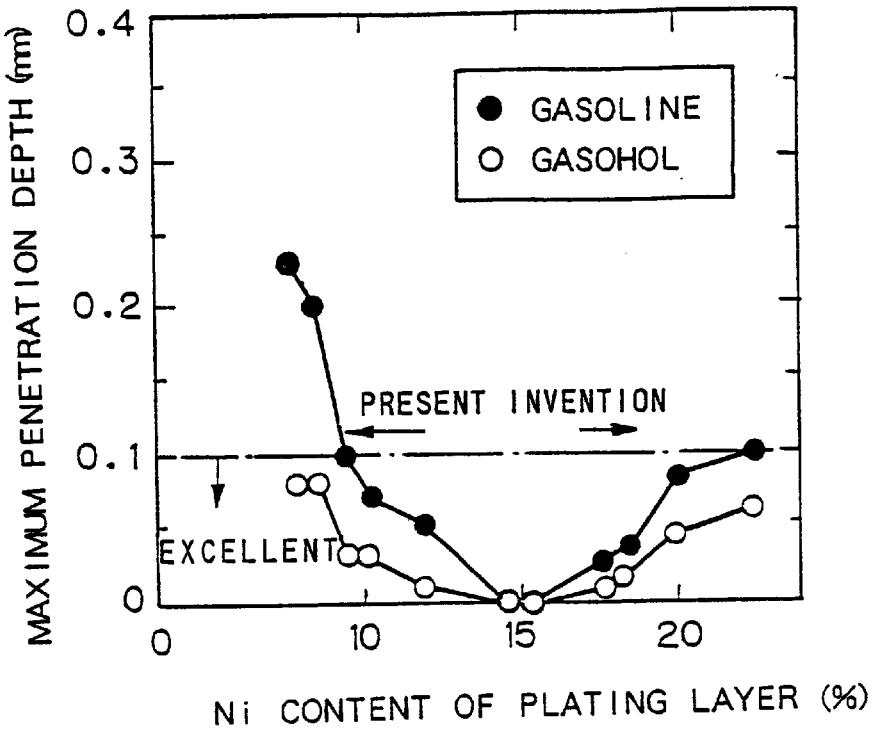
FIG. 3*a* through FIG. 3*d* are graphs showing the effect of the content of X over the whole plating layer (the content of X of the plating layer) on fuel corrosion resistance.
Figure 3B:
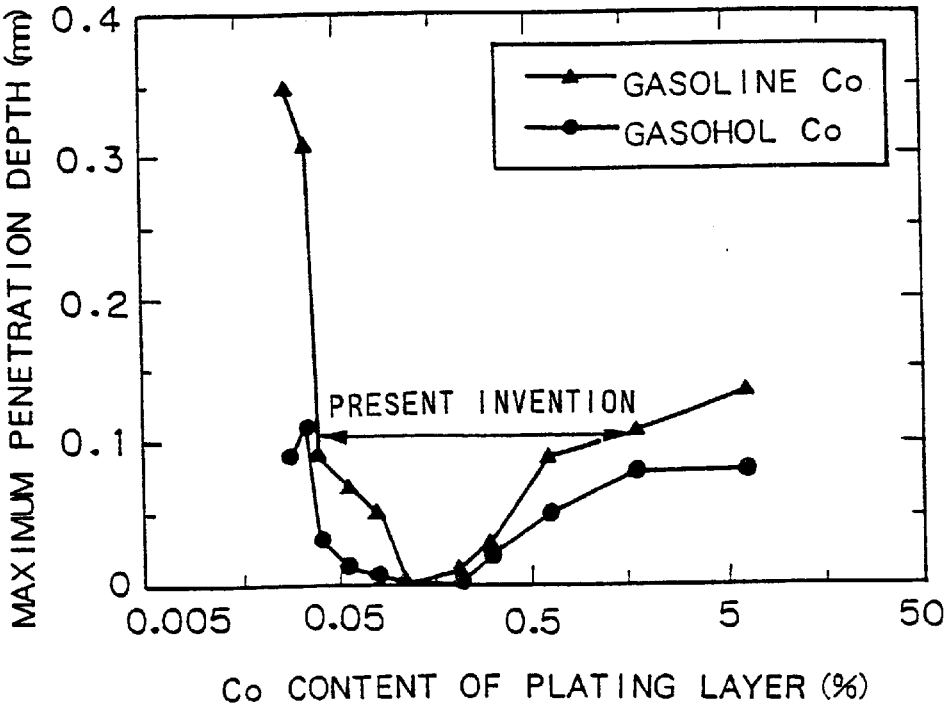
Figure 3C:
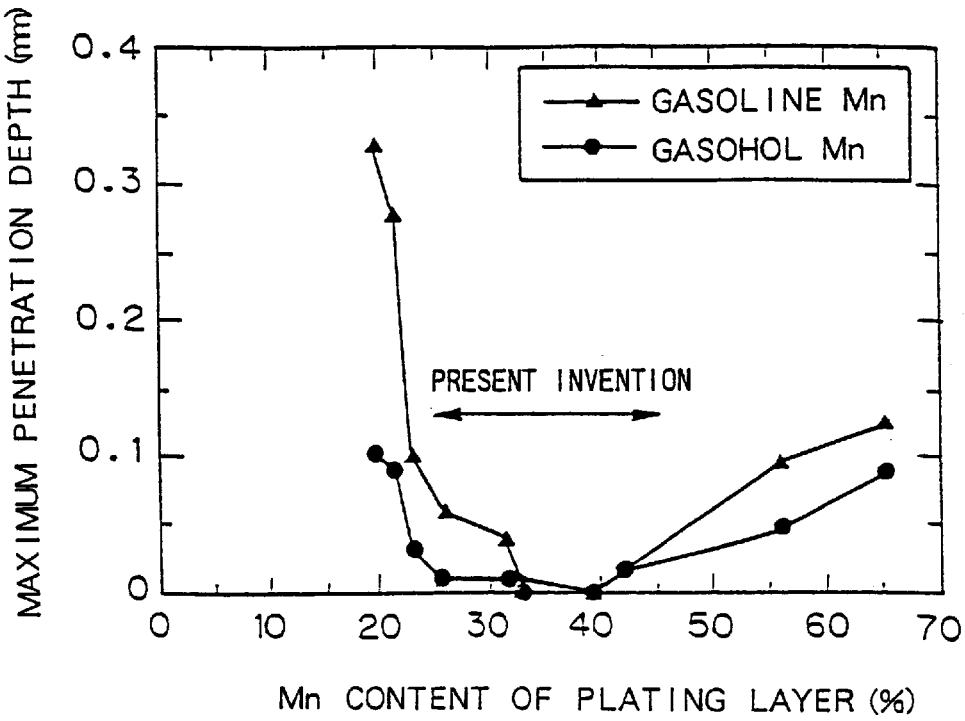
Figure 3D:
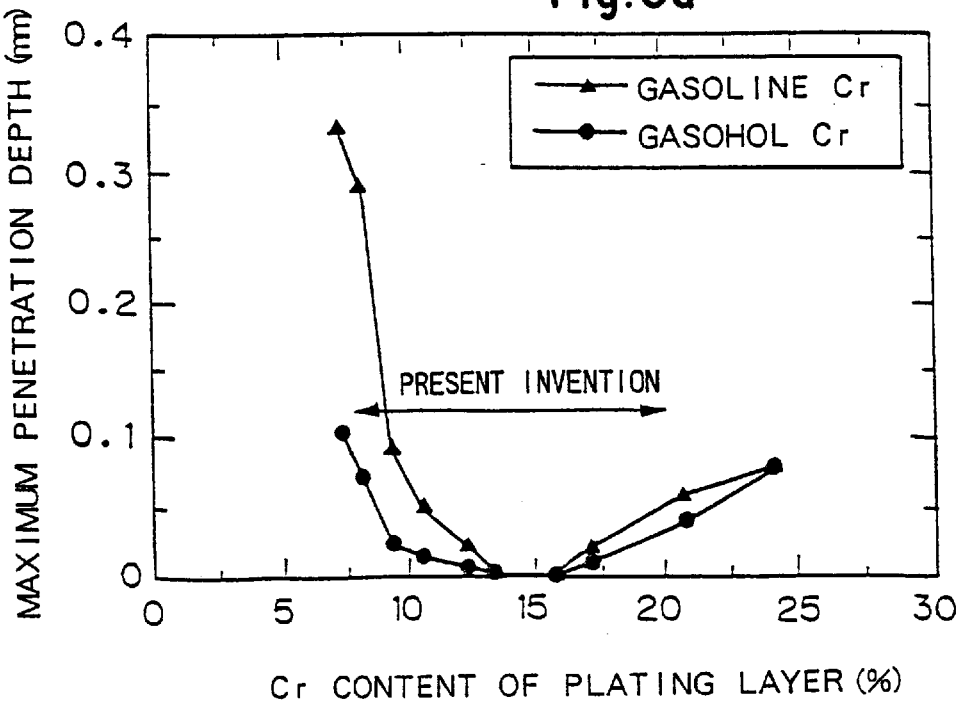

FIG. 2 is a graph showing the effect of the amount of electrodeposition on fuel corrosion resistance.

Conditions

X content of plating layer: Ni: 13%, Co: 0.3%, Mn: 34%, Cr: 13%,

Crack density: 4300±500 (cracks/mm$^2$), in case of Ni, 3500 (cracks/mm$^2$)

Maximum width of cracks: 0.1 μm

Chromate amount: 65±5 mg/m$^2$ $SiO_2$/Cr ratio in chromate film: 2.0±0.1 (Dry $SiO_2$)

FIG. 3*a* through FIG. 3*d*

FIG. 3*a* through FIG. 3*d* are graphs showing the effect of the content of X over the whole plating layer (the content of X of the plating layer) on fuel corrosion resistance.

Conditions

Amount of the plating layer: 20±2 g/m$^2$

Crack density: 4300±500 (cracks/mm$^2$), in case of Ni, 3500 (cracks/mm$^2$)

Maximum width of cracks: 0.1 μm

Chromate amount: 65±5 mg/m$^2$ $SiO_2$/Cr ratio in chromate film: 2.0±0.1 (Dry $SiO_2$)

FIG. 4

Figure 4:
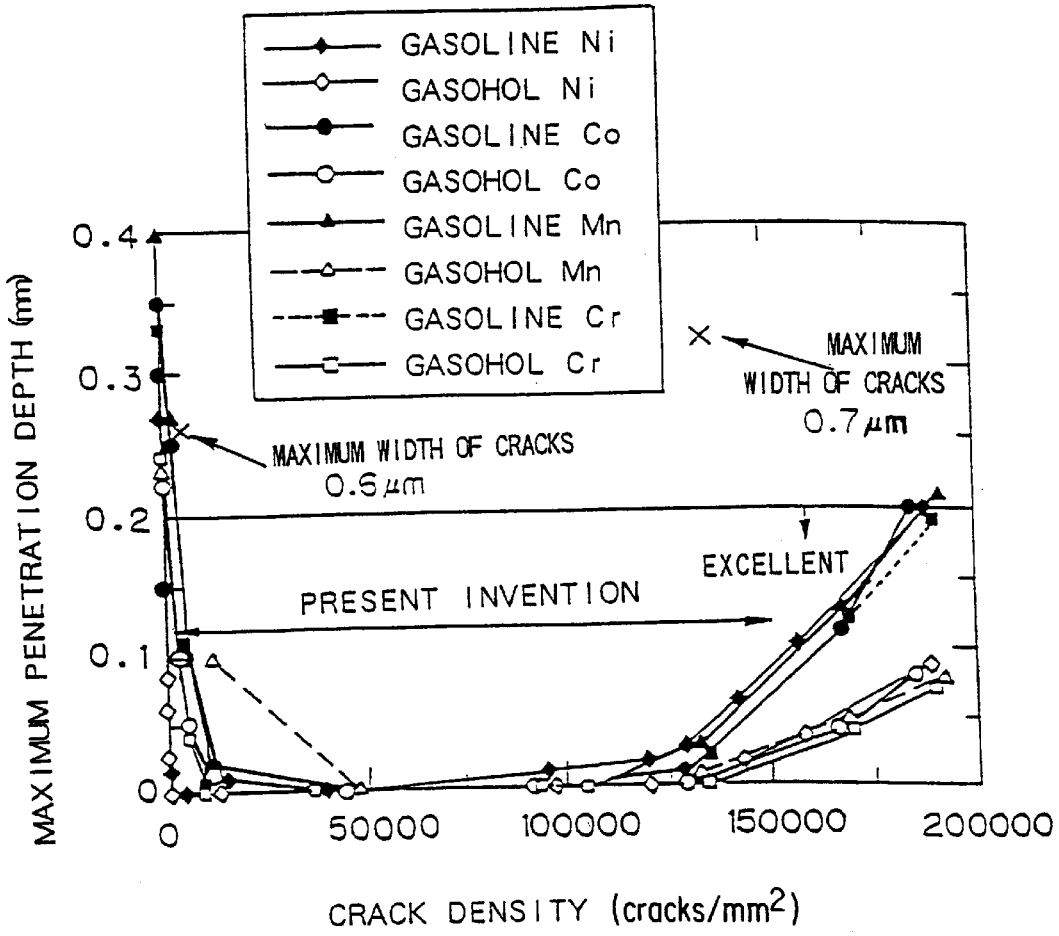
FIG. 4 is a graph showing the effect of the density of cracks formed in the surface of a plating layer on fuel corrosion resistance.

FIG. 4 is a graph showing the effect of the density of cracks formed in the surface of a plating layer on fuel corrosion resistance.

Conditions

Amount of the plating layer: 20±2 g/m$^2$

X content of plating layer: Ni: 13%, Co: 0.3%, Mn: 34%, Cr: 13%,

Maximum width of cracks: 0.1 μm

Chromate amount: 60±5 mg/m$^2$ $SiO_2$/Cr ratio in chromate film: 2.0±0.1 (Dry $SiO_2$)

FIG. 5

Figure 5:
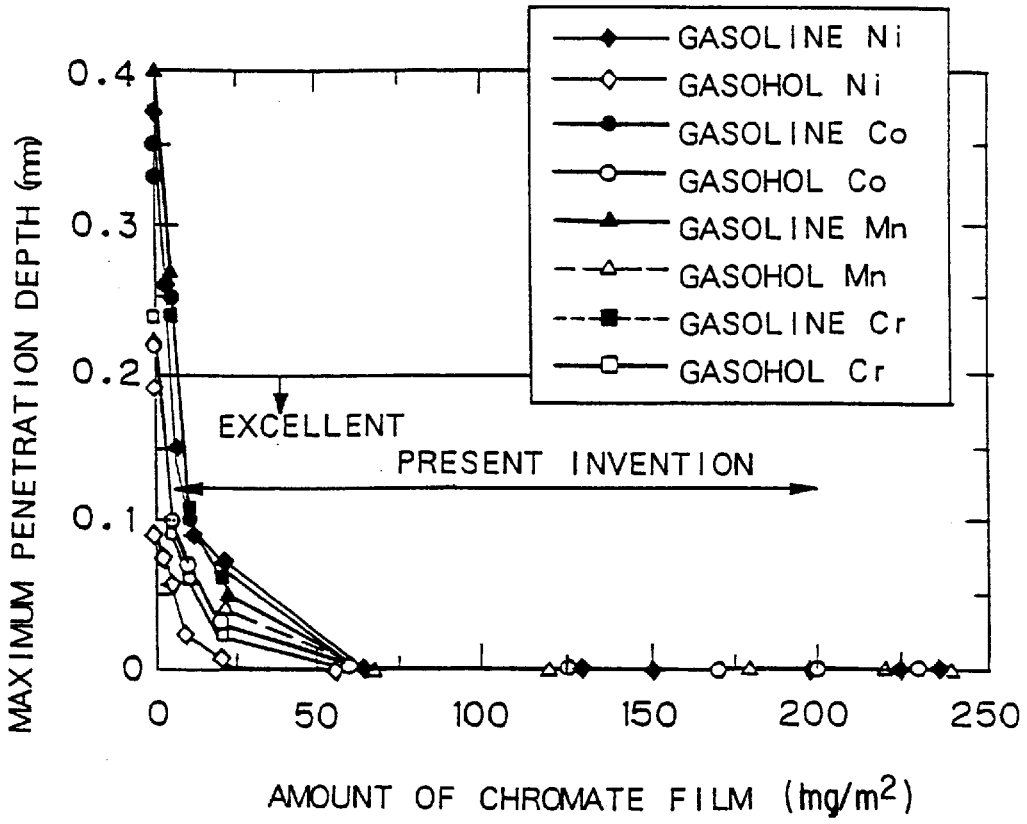
FIG. 5 is a graph showing the effect of the amount of a chromate film on fuel corrosion resistance.

FIG. 5 is a graph showing the effect of the amount of a chromate film on fuel corrosion resistance.

Conditions

Amount of the plating layer: 20±2 g/m$^2$

X content of plating layer: Ni: 13%, Co: 0.3%, Mn: 34%, Cr: 13%,

Crack density: 4300±500 (cracks/mm$^2$), in case of Ni, 3500 (cracks/mm$^2$)

Maximum width of cracks: 0.1 μm $SiO_2$/Cr ratio in chromate film: 2.0±0.1 (Dry $SiO_2$)

FIG. 6

Figure 6:
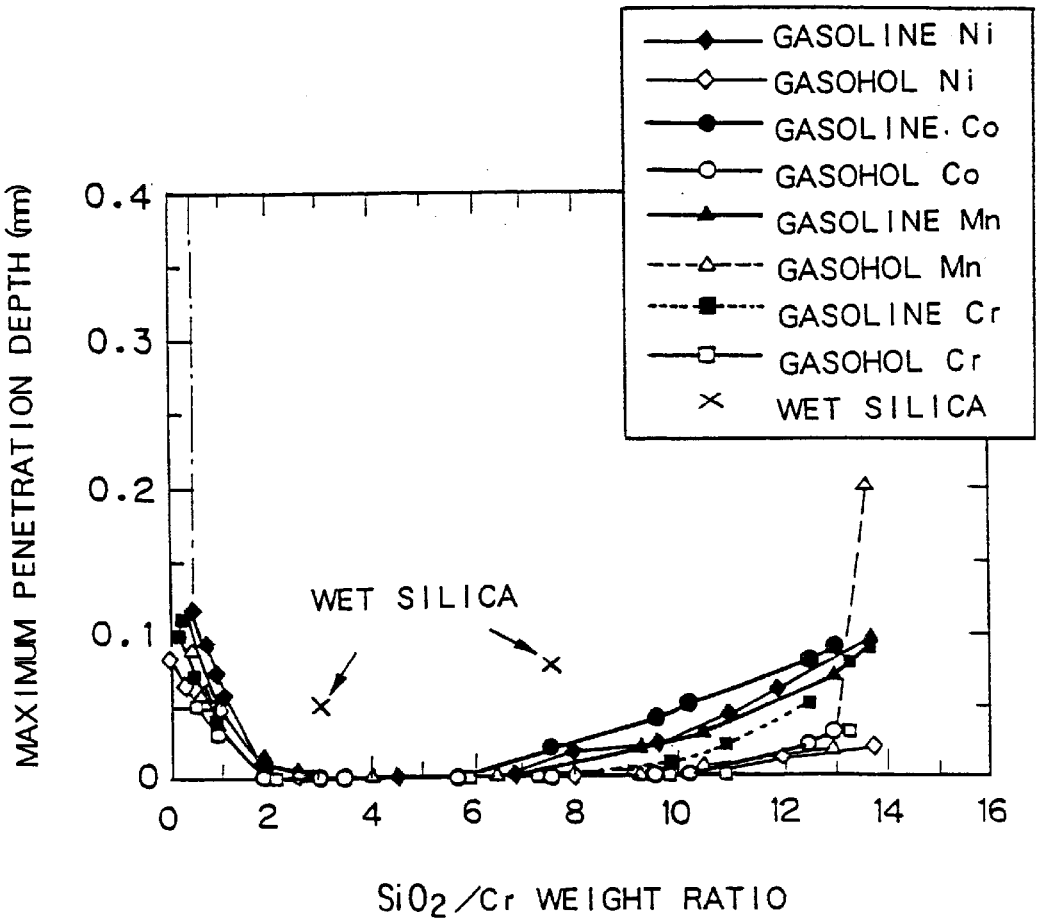
FIG. 6 is a graph showing the effect of the amount of silica contained in the chromate film, i.e., $SiO_2$/Cr weight ratio, on fuel corrosion resistance.

FIG. 6 is a graph showing the effect of the amount of silica contained in the chromate film, i.e., $SiO_2$/Cr weight ratio, on fuel corrosion resistance.

Conditions

Amount of the plating layer: 20±2 g/m$^2$

X content of plating layer: Ni: 13%, Co: 0.3%, Mn: 34%, Cr: 13%,

Crack density: 4300±500 (cracks/mm$^2$), in case of Ni, 3500 (cracks/mm$^2$)

Maximum width of cracks: 0.1 μm

Chromate amount: 65±5 mg/m$^2$

Silica used: Dry $SiO_2$ (except for case X)

FIG. 7

Figure 7:
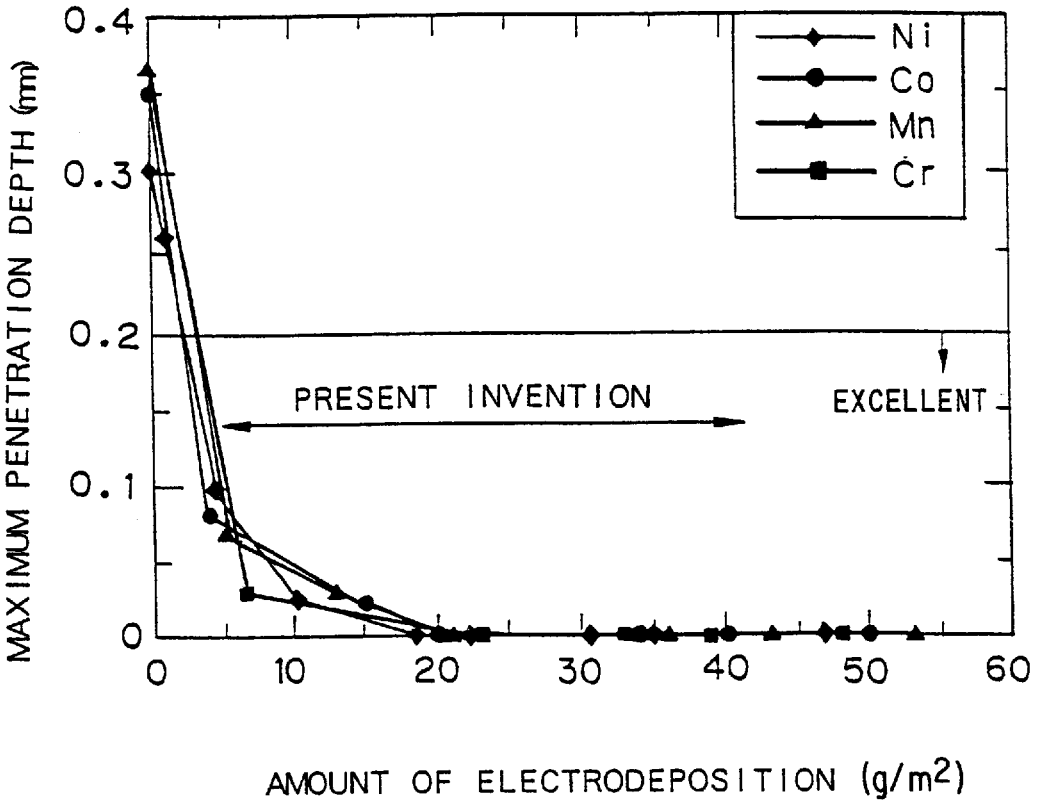
FIG. 7 is a graph showing the effect of the amount of electrodeposition layer on cosmetic corrosion resistance.
Figure 8A:
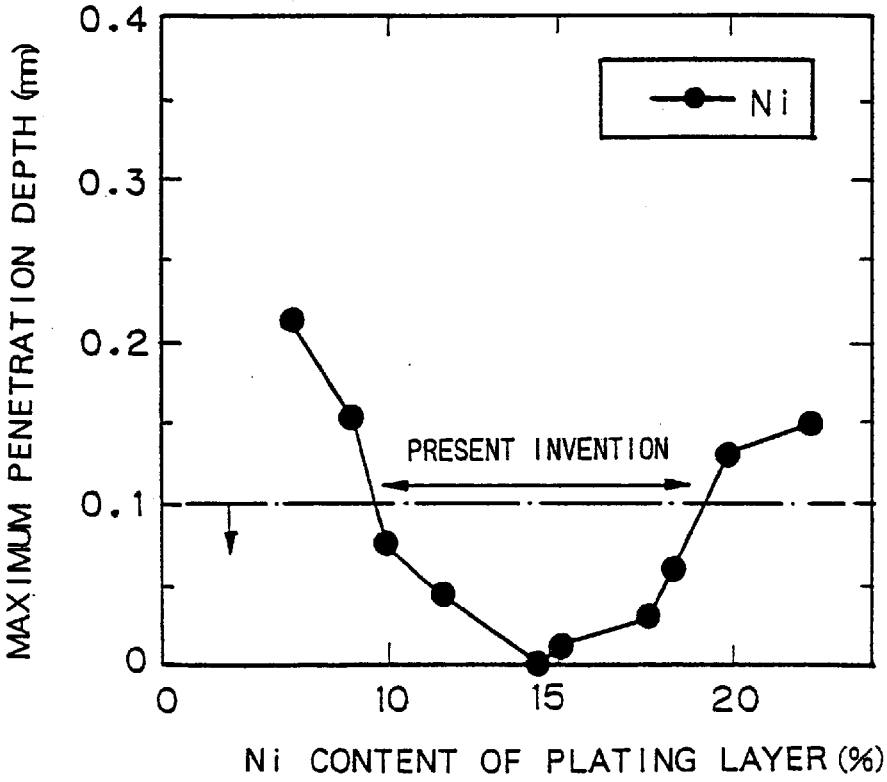
FIG. 8*a* through FIG. 8*d* are graphs showing the effect of the content of X on cosmetic corrosion resistance.
Figure 8B:
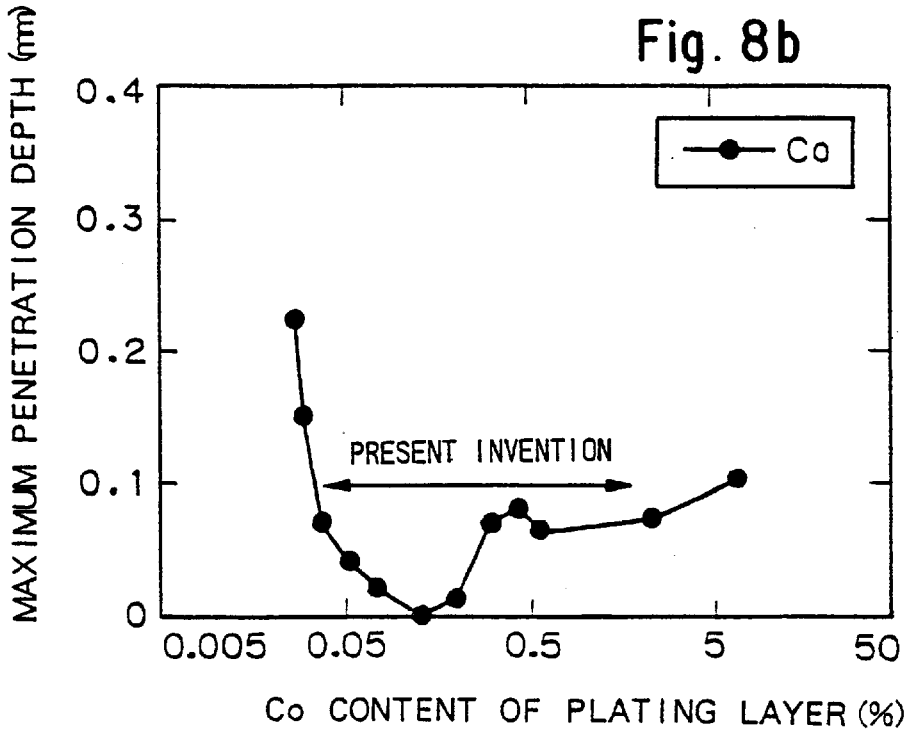
Figure 8C:
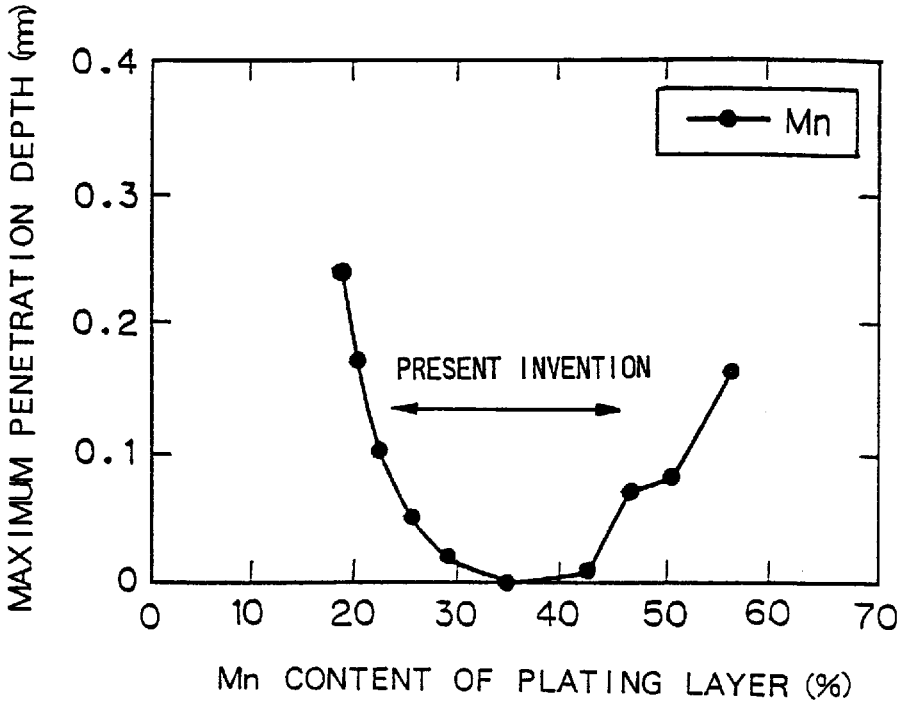
Figure 8D:
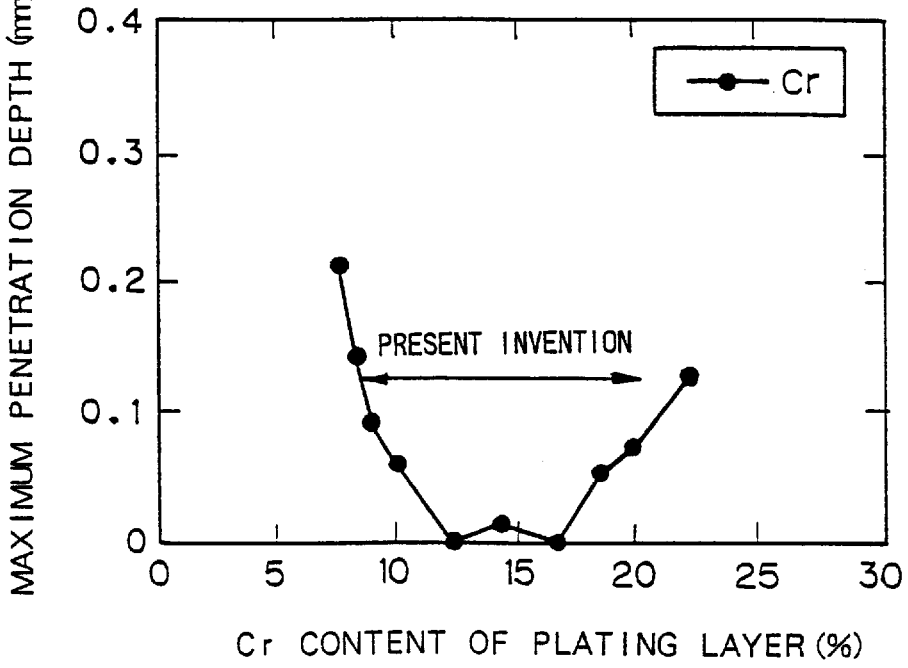

FIG. 7 is a graph showing the effect of the amount of electrodeposition layer on cosmetic corrosion resistance.

Conditions

X content of plating layer: Ni: 13%, Co: 0.3%, Mn: 34%, Cr: 13%,

Crack density: 4300±500 (cracks/mm$^2$), in case of Ni, 3500 (cracks/mm$^2$)

Maximum width of cracks: 0.1 μm

Chromate amount: 65±5 mg/m$^2$ $SiO_2$/Cr ratio in chromate film: 2.0±0.1 (Dry $SiO_2$)

FIG. 8*a* through FIG. 8*d*

FIG. 8*a* through FIG. 8*d* are graphs showing the effect of the content of X on cosmetic corrosion resistance.

Conditions

Amount of the plating layer: 19 g/m$^2$

Crack density: 4300±500 (cracks/mm$^2$), in case of Ni, 3500 (cracks/mm$^2$)

Maximum width of cracks: 0.1 82 m

Chromate amount: 65±5 mg/m$^2$ $SiO_2$/Cr ratio in chromate film: 2.0±0.1 (Dry $SiO_2$)

Figure 9A:
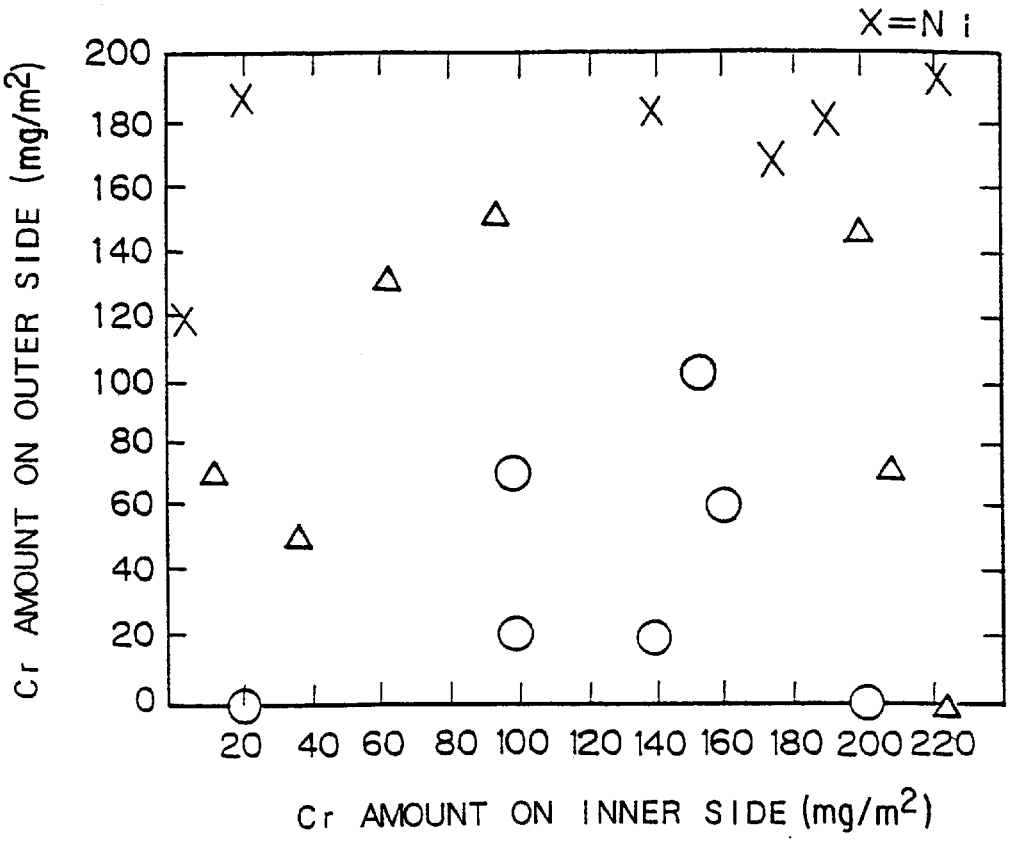
FIG. 9*a* and FIG. 9*b* are graphs showing the effect of the amount of a chromate film on both the inner and outer sides on seam weldability for the case of a Zn—X alloy (X=Ni or Co), respectively.

FIG. 9*a* and FIG. 9,b

Figure 9B:
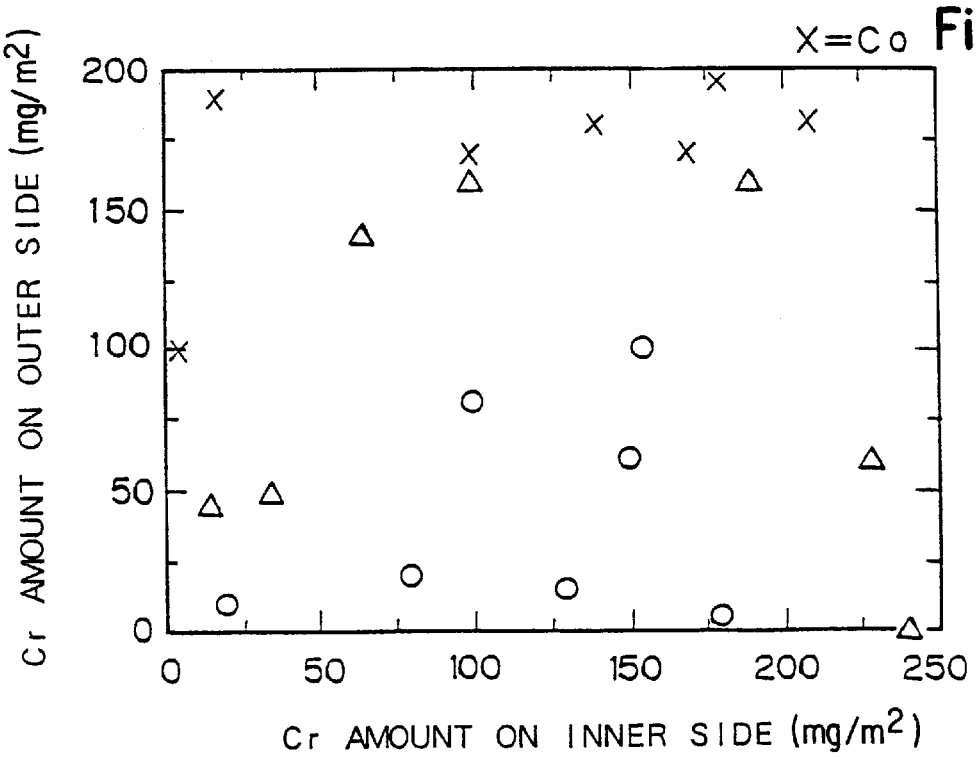
Figure 10A:
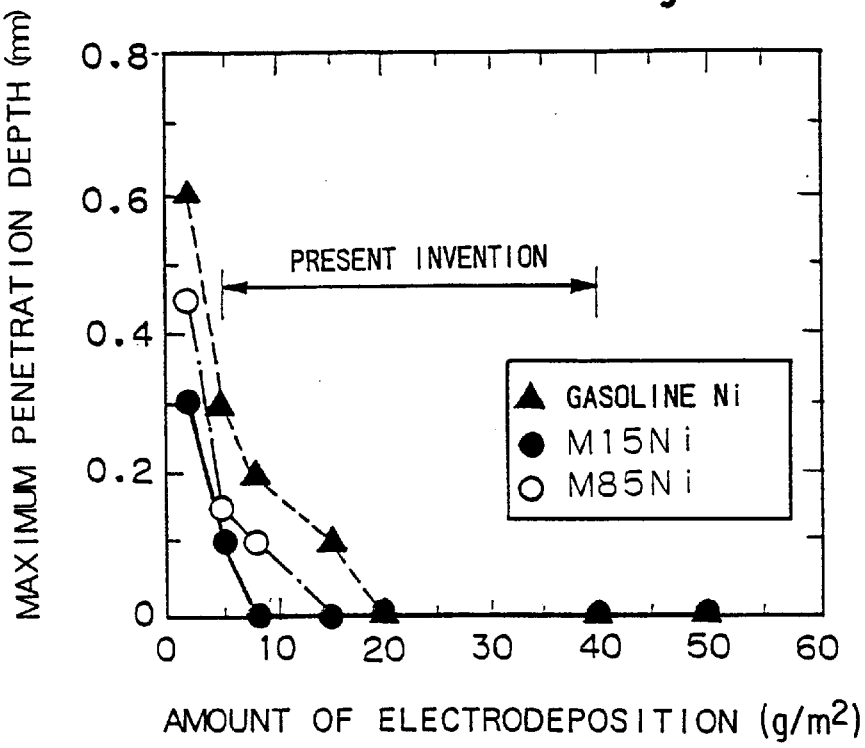
FIG. 10*a* through FIG. 10*d* are graphs showing the effect of the amount of a plating layer on fuel corrosion resistance.
Figure 10B:
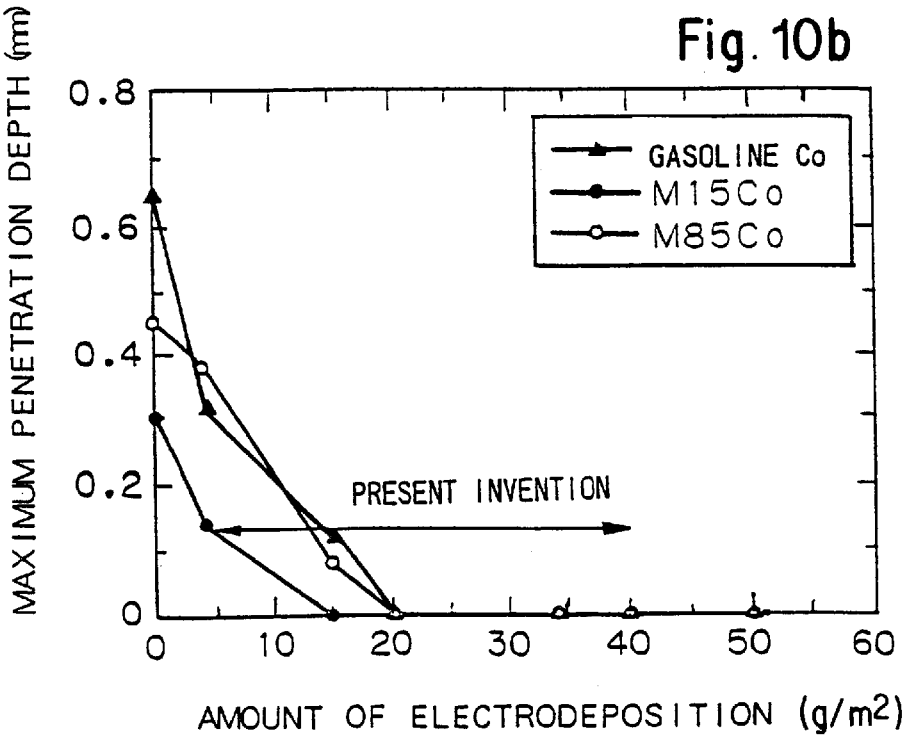
Figure 10C:
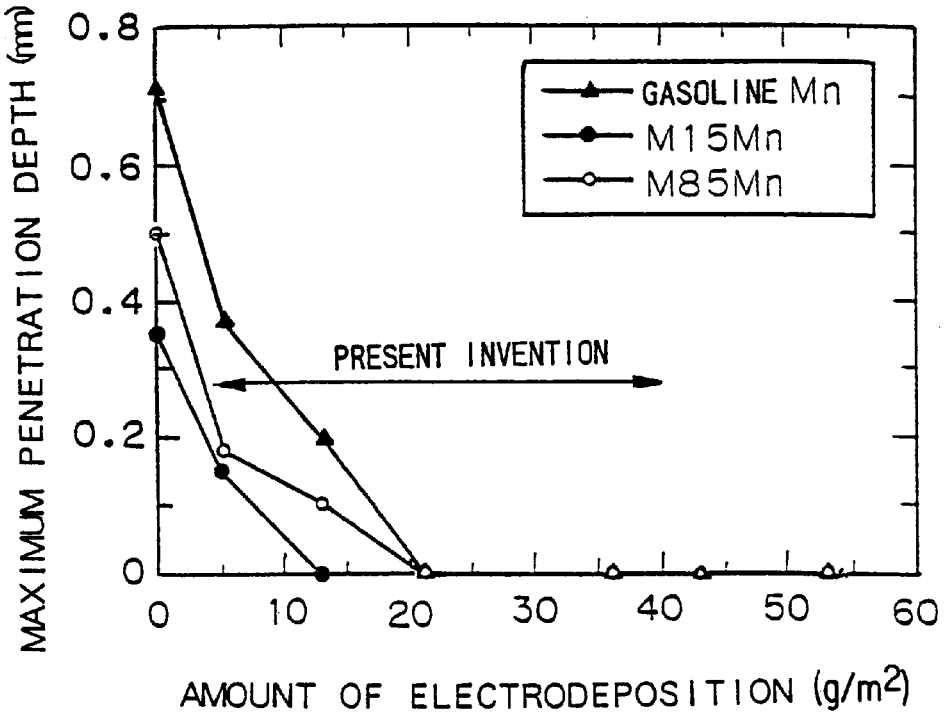
Figure 10D:
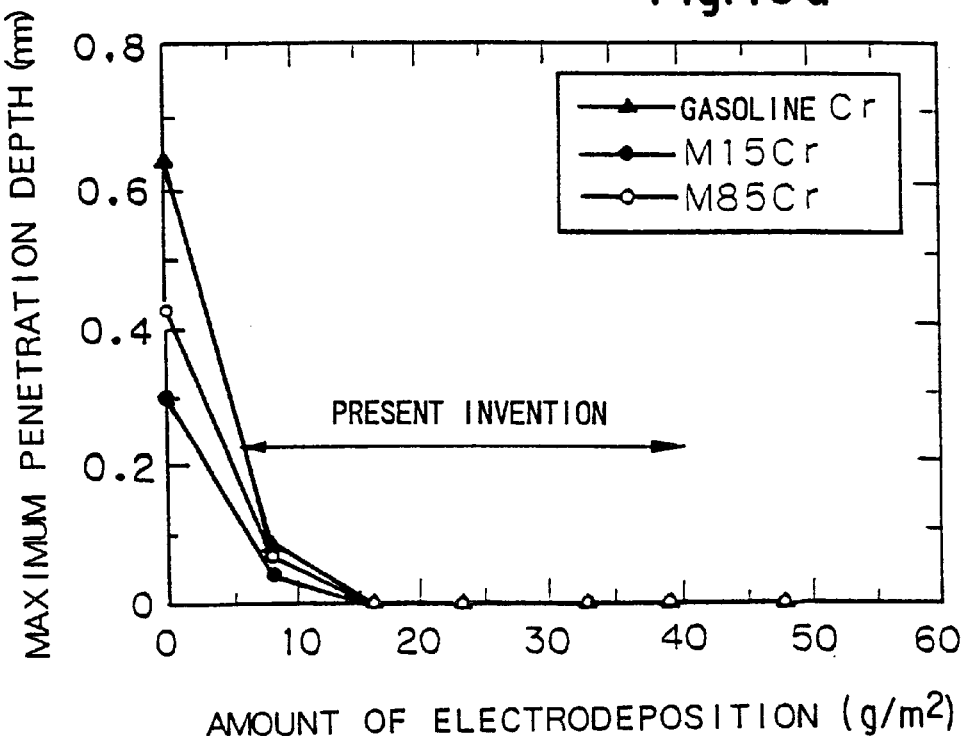
Figure 11A:
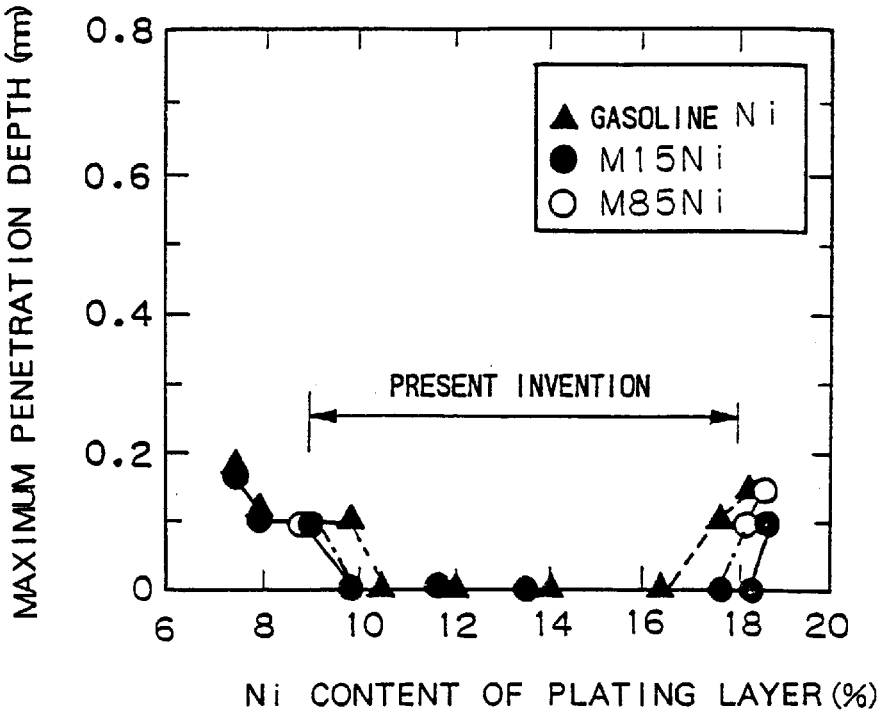
FIG. 11*a* through FIG. 11*d* are graphs showing the effect of the content of X over the whole plating layer (the content of X of the plating layer) respectively on fuel corrosion resistance.
Figure 11B:
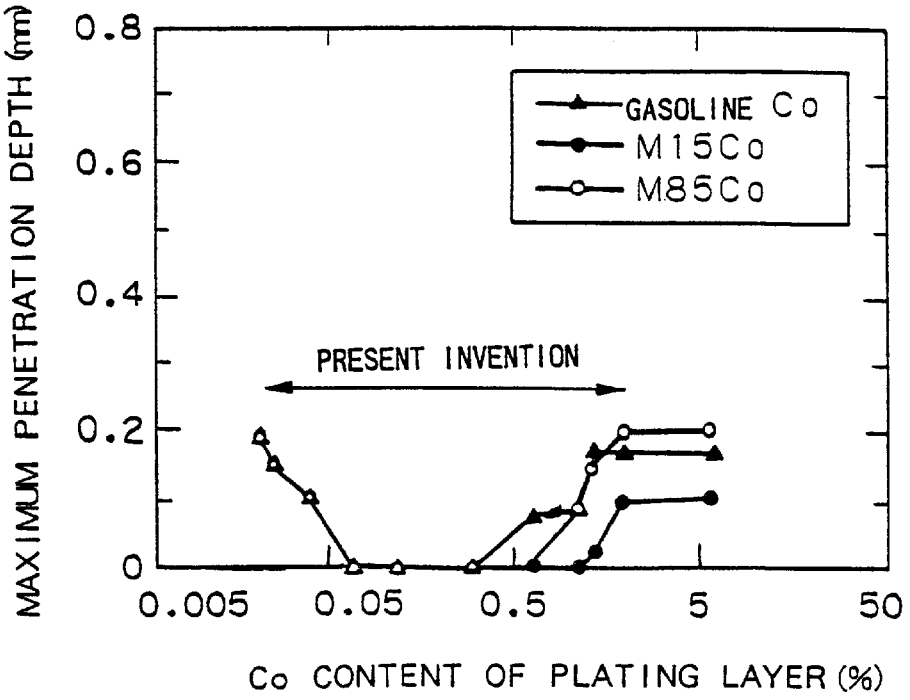
Figure 11C:
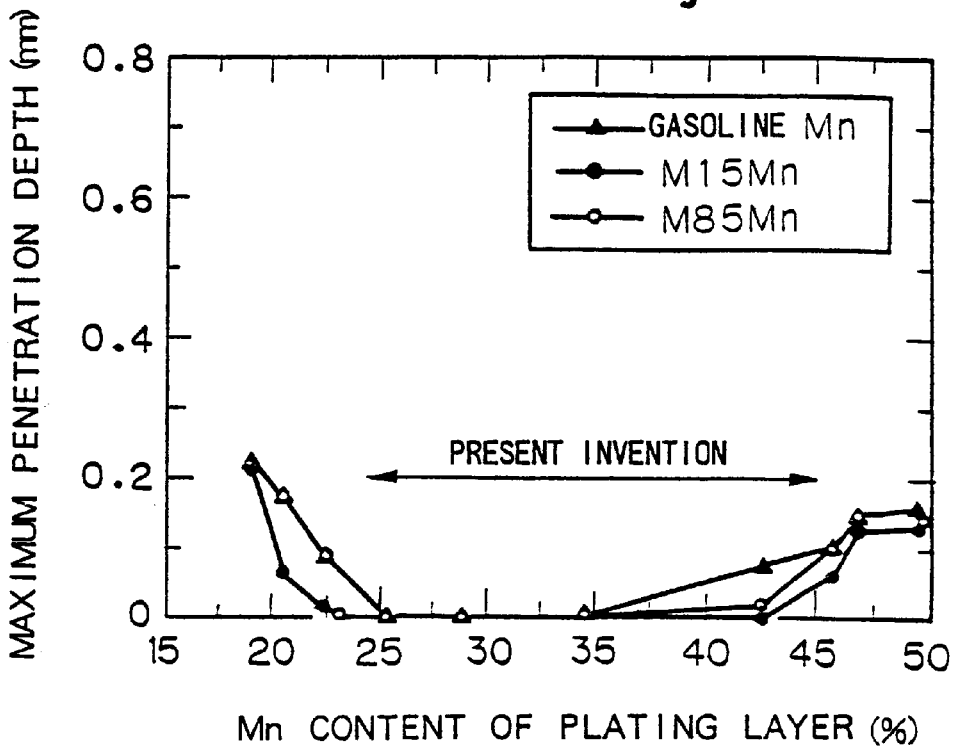
Figure 11D:
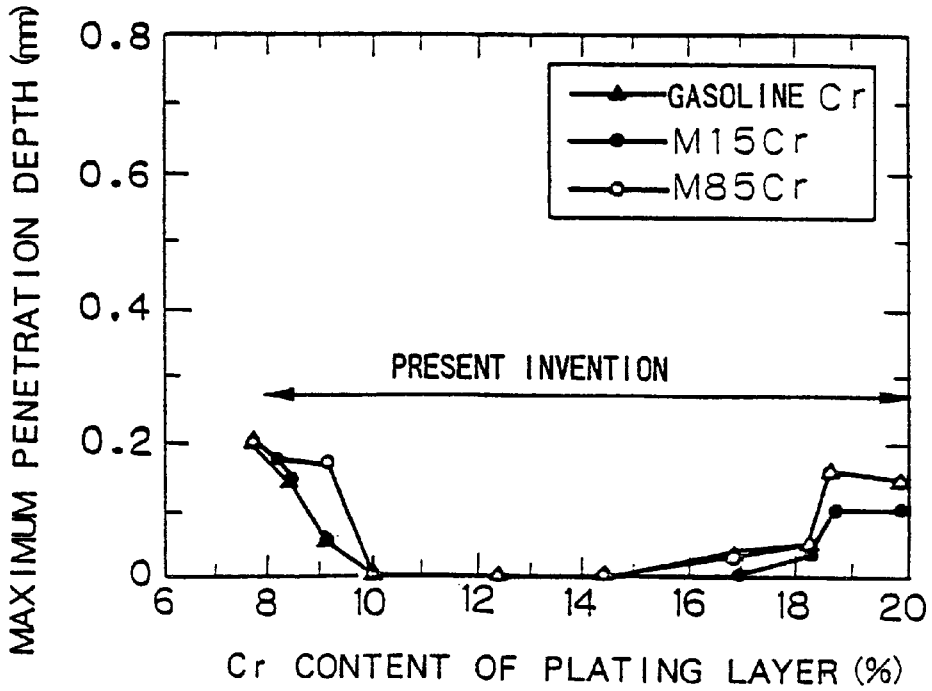
Figure 12A:
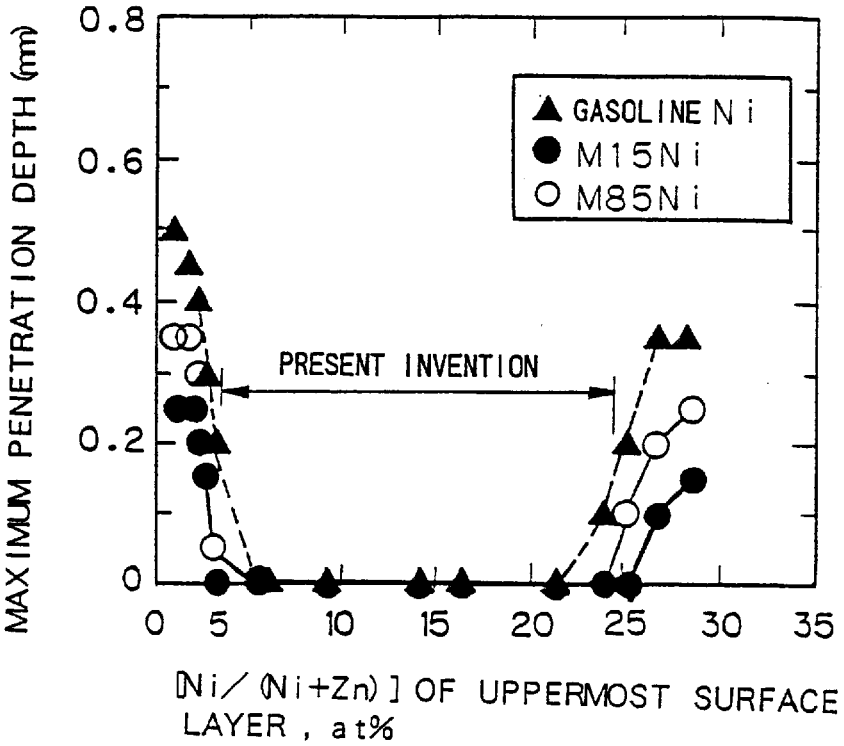
FIG. 12*a* through FIG. 12*d* are graphs showing the effect of the content of X in the uppermost surface layer, i.e., X/(X+Zn) atomic percentage, on fuel corrosion resistance.
Figure 12B:
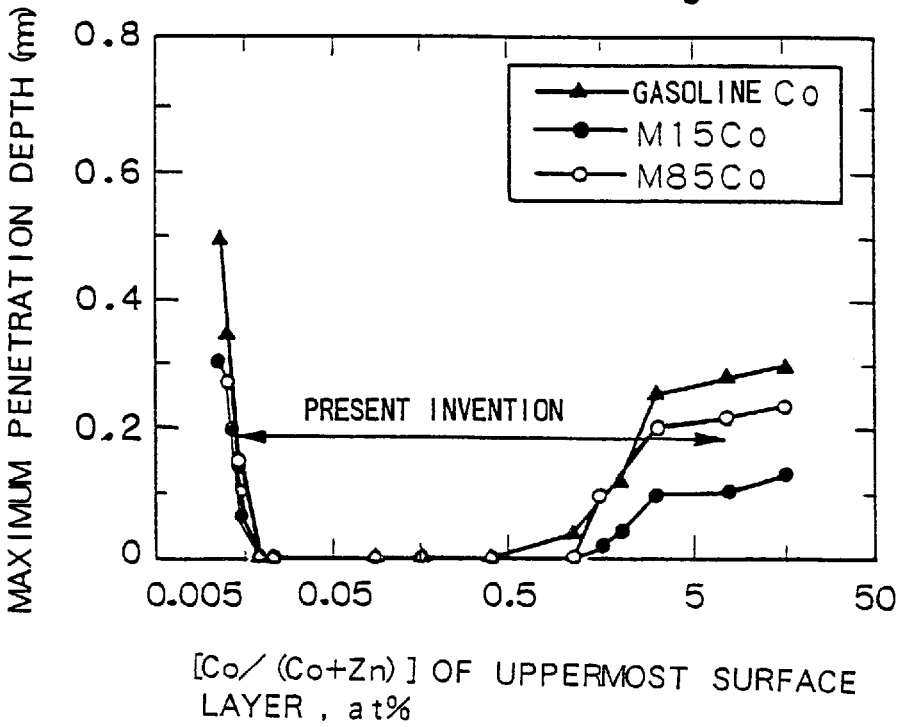
Figure 12C:
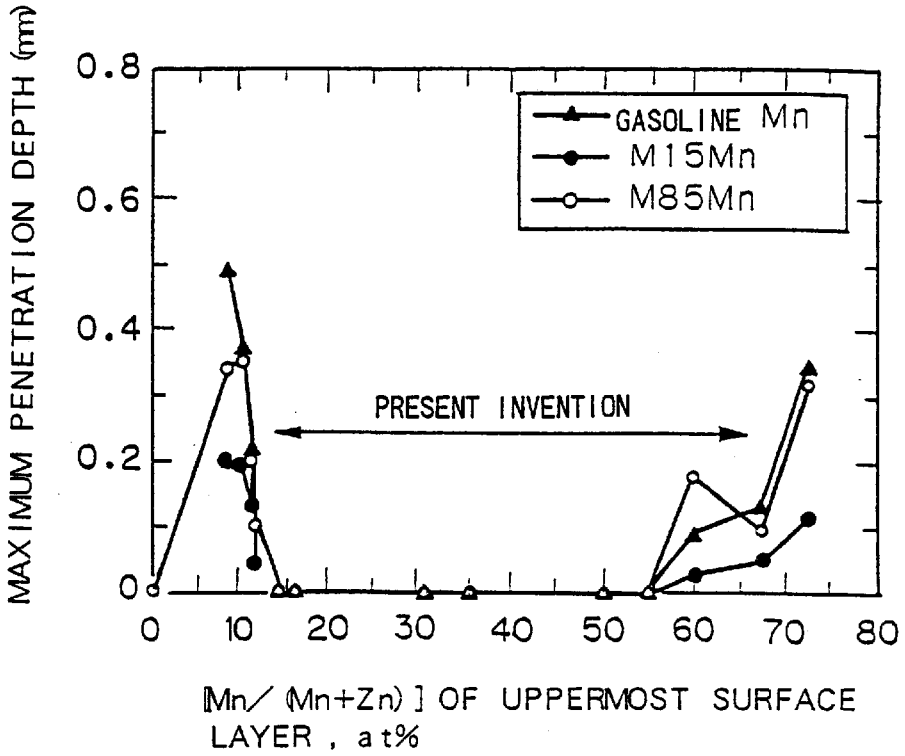
Figure 12D:
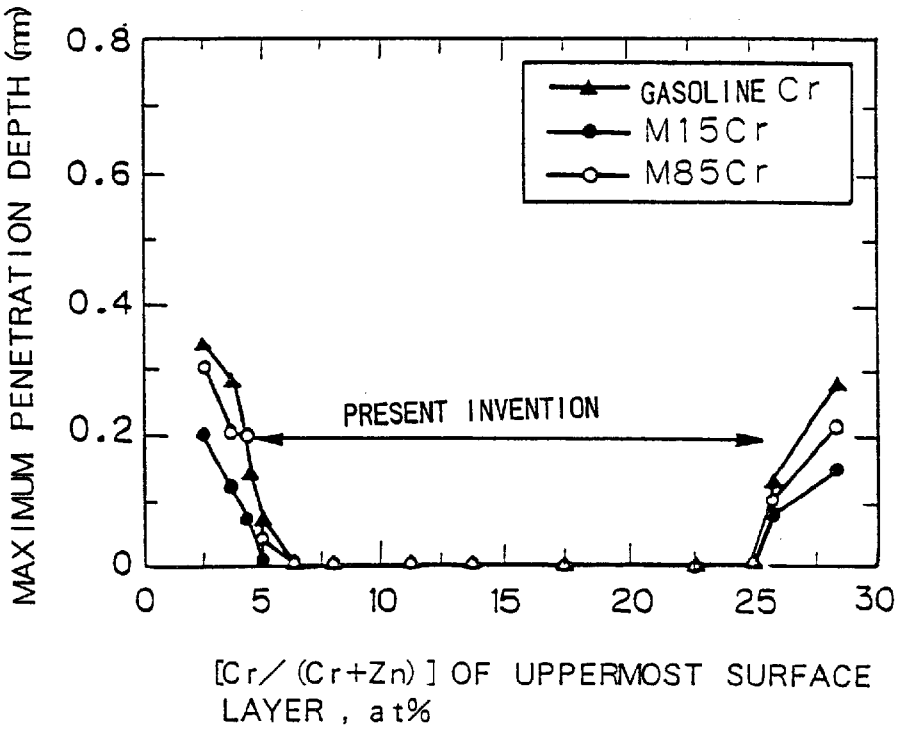
Figure 13A:
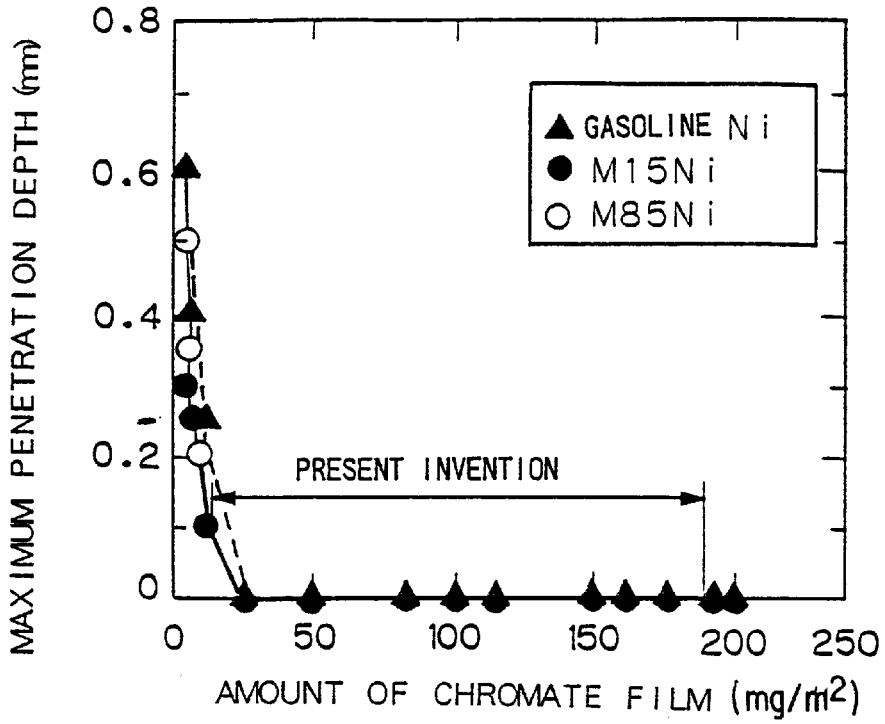
FIG. 13*a* through 13*d* are graphs showing the effect of the amount of a chromate film on fuel corrosion resistance.
Figure 13B:
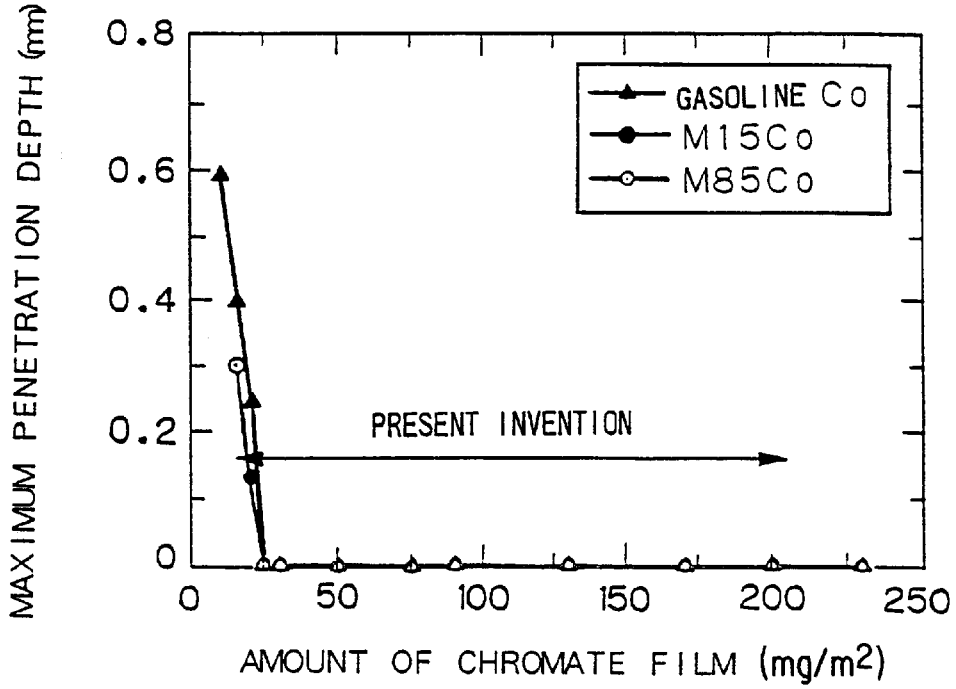
Figure 13C:
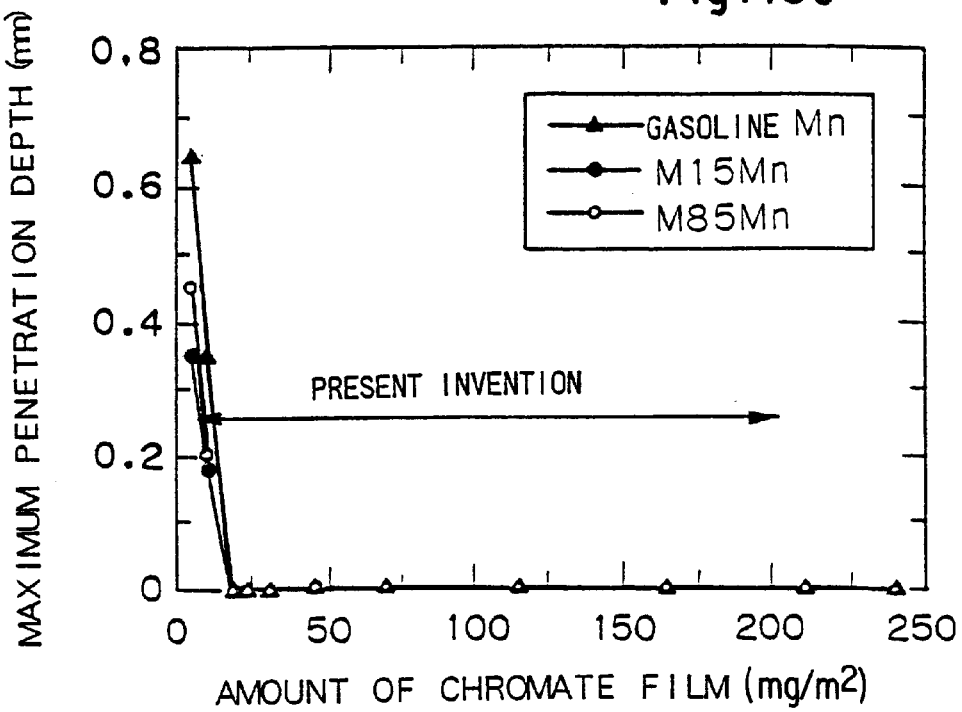
Figure 13D:
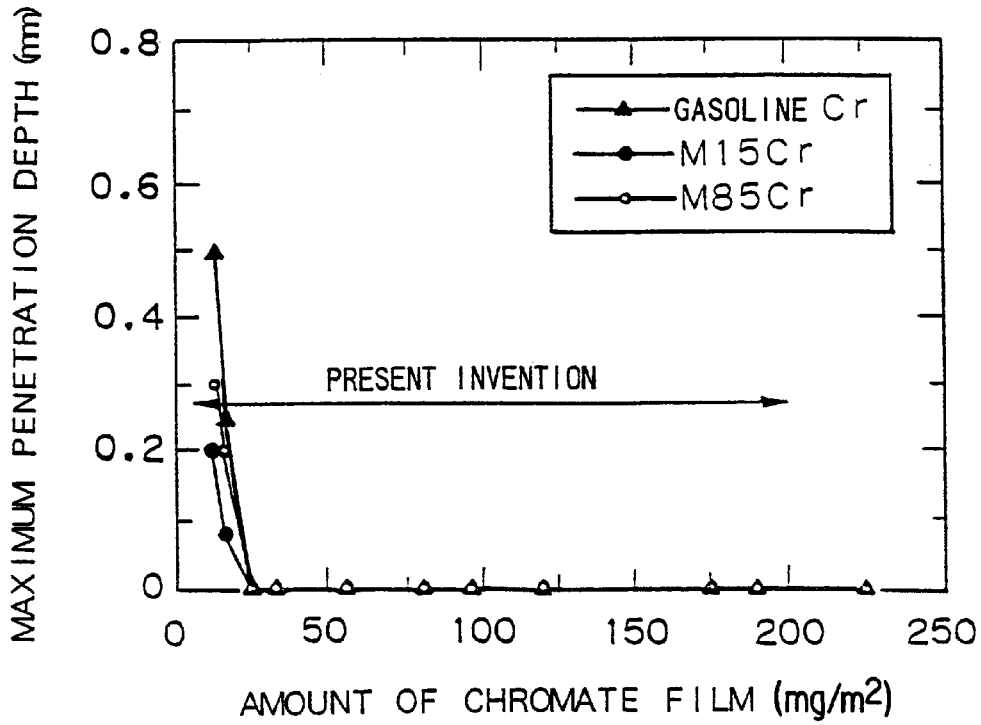
Figure 14A:
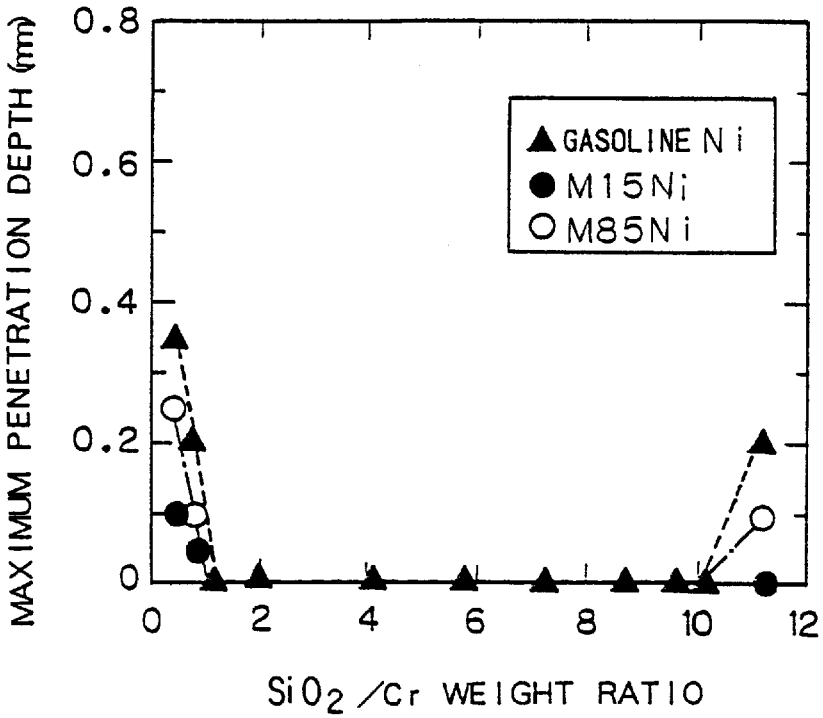
FIG. 14*a* through 14*d* are graphs showing the effect of the amount of silica contained in the chromate film, i.e., $SiO_2$/Cr weight ratio, on fuel corrosion resistance.
Figure 14B:
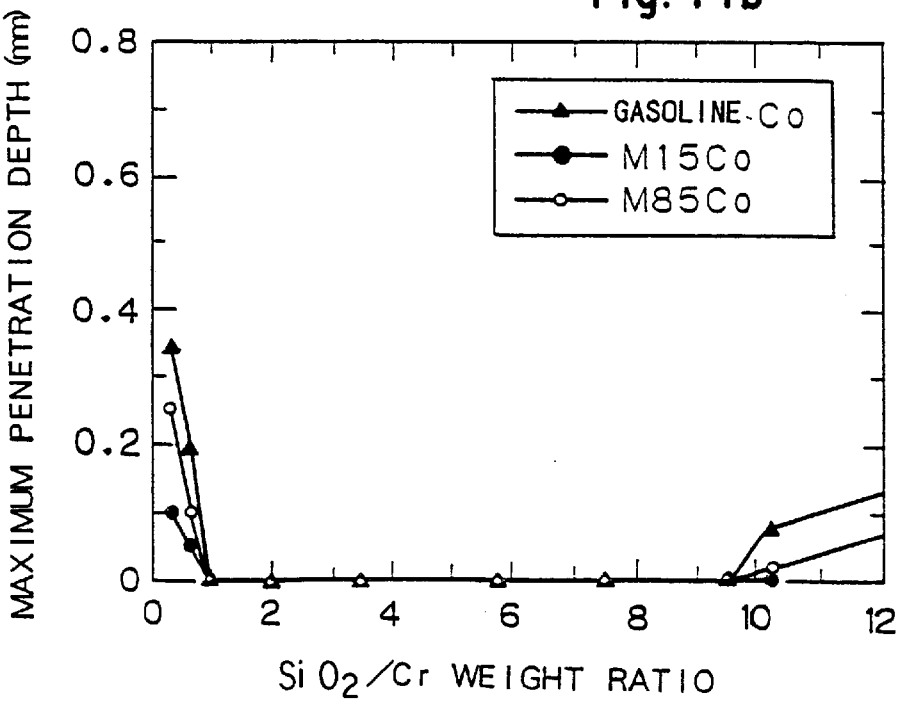
Figure 14C:
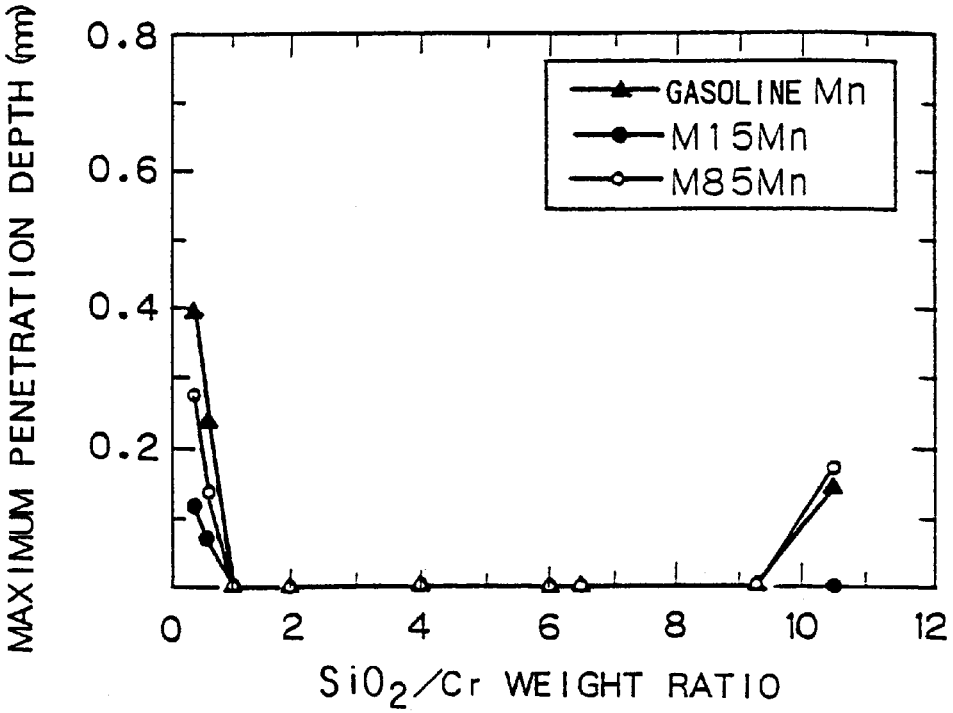
Figure 14D:
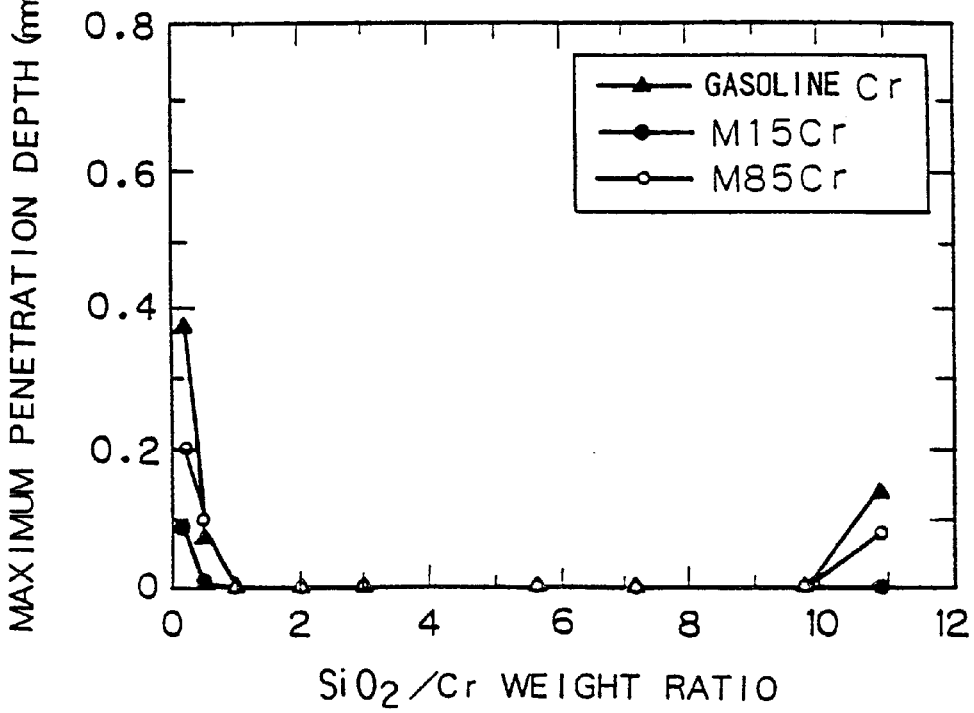

FIG. 9*a* and FIG. 9*b* are graphs showing the effect of the amount of a chromate film on both the inner and outer sides on seam weldability for a Zn—X alloy (X=Ni or Co).

Conditions

X:Ni, Co

Amount of the plating layer: 19 g/m$^2$

X content of plating layer: Ni: 13%, Co: 0.3%

Crack density: 4300±500 (cracks/mm$^2$), in case of Ni, 3500 (cracks/mm$^2$)

Maximum width of cracks: 0.1 $\mu$m $SiO_2$/Cr ratio in chromate film: 2.0±0.1 (Dry $SiO_2$)

It is apparent from FIGS. 2 through 8 that cosmetic corrosion resistance is excellent (maximum depth of penetration is less than 0.1 mm) when the amount of a Zn—X alloy plating layer is 5–40 g/m$^2$, and the average X content over the plating layer is: Ni: 9–18%, Co: 0.02–3%, Mn: 25–45%, Cr: 8–20%, and that fuel corrosion resistance on the inner side is excellent when the amount of the Zn—X alloy plating layer and the maximum width of cracks are within the range of the present invention and the amount of the chromate film is 10 mg/m$^2$ or more on a metallic Cr basis.

Furthermore, it is noted from FIG. 9 that seam weldability is excellent when the amount of the chromate film on the inner side of fuel tanks is rather thick and the amount of the chromate film on the outer side of the fuel tanks is restricted to 100 mg/m$^2$, particularly to 50 mg/m$^2$ or less.

Example 2

Preparation of Samples of Surface-Treated Steel Sheet

A cold-rolled steel sheet corresponding to JIS SPCE and having a thickness of 0.8 mm was electroplated with a Zn—X alloy on both sides of the sheet using a sulfate bath under the same conditions as in Example 1 to form a Zn—X alloy plated steel sheet. After electroplating was finished, plating layers on both the sides of the plated steel sheet were subjected to etching using the same electroplating sulfate bath by immersing the sheet in the acidic plating solution to increase the X content in the uppermost surface compared with that on average over the Zn—X alloy plating layer. The X content in the uppermost surface was varied by adjusting the immersion time in the electroplating solution. After completion of etching, the X content in the uppermost surface, i.e., the X/(X+Zn) atomic percentage was determined using ESCA.

After the etching was applied to the surface of the plating layer on both sides of the Zn—X alloy plated steel sheet, a chromate solution of the coating type was applied to both surfaces, and the chromate coating was baked to form a chromate film in the same manner as in Example 1. The surface-treated steel sheet according to the second aspect of the present invention was produced. The silica used was the same dry silica as used in Example 1. The amount of the chromate film was varied for the different sides, i.e., 120 mg/m$^2$ for one side corresponding to the inner side of tanks, and 50 mg/m$^2$ for the other side corresponding to the outer side of tanks.

The thus-prepared surface-treated steel sheets were subjected to evaluation of fuel corrosion resistance against gasoline and alcohol-containing fuel, and cosmetic corrosion resistance in the same manner as in Example 1. Three types of fuels were used for evaluating fuel corrosion resistance: 30 ml each of gasoline (indicated by the symbol ▲), gasohol M15 (indicated by the symbol ●), and gasohol M85 (indicated by the symbol ○) with the following compositions.

Fuel Compositions

Gasoline: Regular gasoline 95%

5% NaCl aqueous solution 5%

Gasohol M15: Regular gasoline 84%

Aggressive methanol 15%

Distilled Water 1%

Gasohol M85: Regular gasoline 15%

Aggressive methanol 85%

Test results are shown by graphs in FIGS. 10 through 19, in which the test conditions were as follows.

FIGS. 10 through 19 were obtained under the following test procedures.

FIG. 10*a* through FIG. 10*d*

FIG. 10*a* through FIG. 10*d* are graphs showing the effect of the amount of electrodeposition on fuel corrosion resistance.

Conditions

X content of plating layer: Ni: 12%, Co: 0.3%, Mn: 34%, Cr: 13%,

X/(X+Zn) in the uppermost surface layer: Ni: 6 at %, Co: 0.4 at %, Mn: 50 at %, Cr: 17.5 at %

Chromate amount: 125±5 mg/m$^2$ $SiO_2$/Cr ratio in chromate film: 2.0±0.1 (Dry $SiO_2$)

FIG. 11*a* through FIG. 11*d*

FIG. 11*a* through FIG. 11*d* are graphs showing the effect of the content of X over the whole plating layer (the content of X of the plating layer) on fuel corrosion resistance.

Conditions

Amount of the plating layer: 20±2 g/m$^2$

X/(X+Zn) in the uppermost surface layer: Ni: 6 at %, Co: 0.4 at %, Mn: 50 at %, Cr: 17.5 at %

Chromate amount: 125±5 mg/m$^2$ $SiO_2$/Cr ratio in chromate film: 2.0±0.1 (Dry $SiO_2$)

FIG. 12*a* through FIG. 12*d*

FIG. 12*a* through FIG. 12*d* are graphs showing the effect of the value of X/(X+Zn) atomic percentage in the uppermost surface layer on fuel corrosion resistance.

Conditions

Amount of the plating layer: 20±2 g/m$^2$

X content of plating layer: Ni: 12%, Co: 0.3%, Mn: 34%, Cr: 13%,

Chromate amount: 125±5 mg/m$^2$ $SiO_2$/Cr ratio in chromate film: 2.0±0.1 (Dry $SiO_2$)

FIG. 13*a* through FIG. 13*d*

FIG. 13*a* through FIG. 13*d* are graphs showing the effect of the amount of a chromate film on fuel corrosion resistance.

Conditions

Amount of the plating layer: 20±2 g/m$^2$

X content of plating layer: Ni: 12%, Co: 0.3%, Mn: 34%, Cr: 13%,

X/(X+Zn) in the uppermost surface layer: Ni: 6 at %, Co: 0.4 at %, Mn: 50 at %, Cr: 17.5 at %

$SiO_2$/Cr ratio in chromate film: 2.0±0.1 (Dry $SiO_2$)

FIG. 14*a* through FIG. 14*d*

FIG. 14*a* through FIG. 14*d* are graphs showing the effect of the amount of a silica contained in the chromate film, i.e., the $SiO_2$/Cr weight ratio, on fuel corrosion resistance.

Conditions

Amount of the plating layer: 20±2 g/m$^2$

X content of plating layer: Ni: 12%, Co: 0.3%, Mn: 34%, Cr: 13%,

X/(X+Zn) in the uppermost surface layer: Ni: 6 at %, Co: 0.4 at %, Mn: 50 at %, Cr: 17.5 at %

Chromate amount: 125±5 mg/m$^2$

FIG. 15

Figure 15:
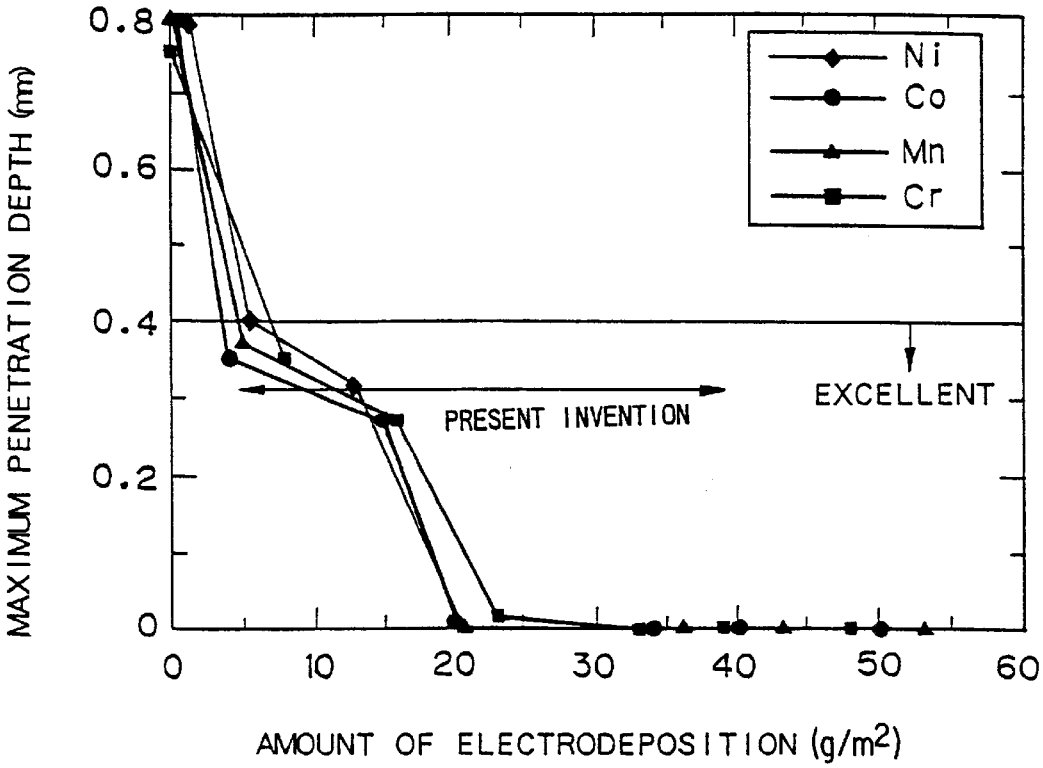
FIG. 15 is a graph showing the effect of the amount of an electrodeposition layer on cosmetic corrosion resistance.
Figure 16A:
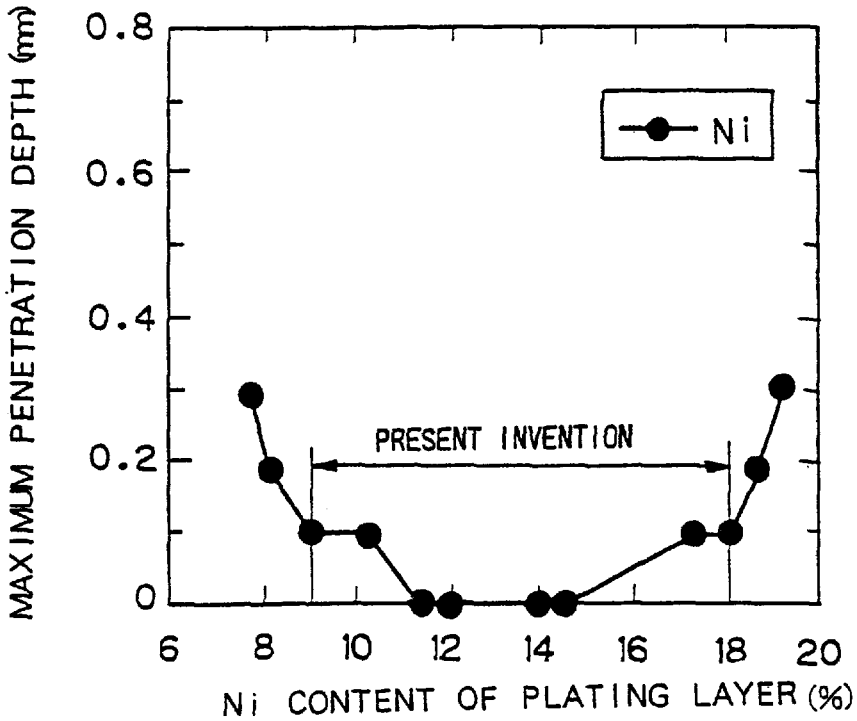
FIG. 16*a* through FIG. 16*d* are graphs showing the effect of the content of X over the whole plating layer (the content of X of the plating layer) on cosmetic corrosion resistance.
Figure 16B:
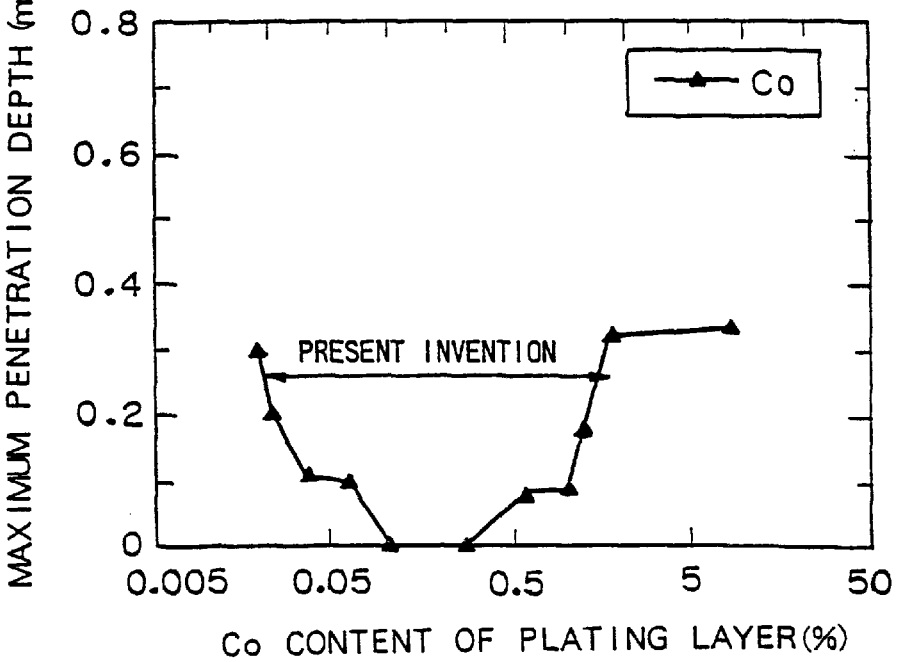
Figure 16C:
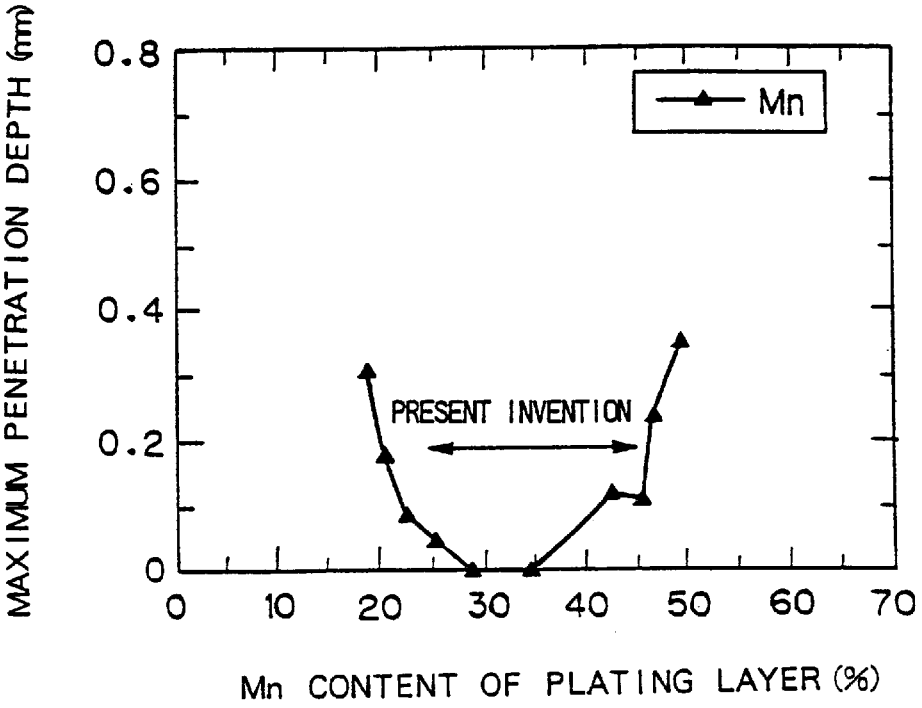
Figure 16D:
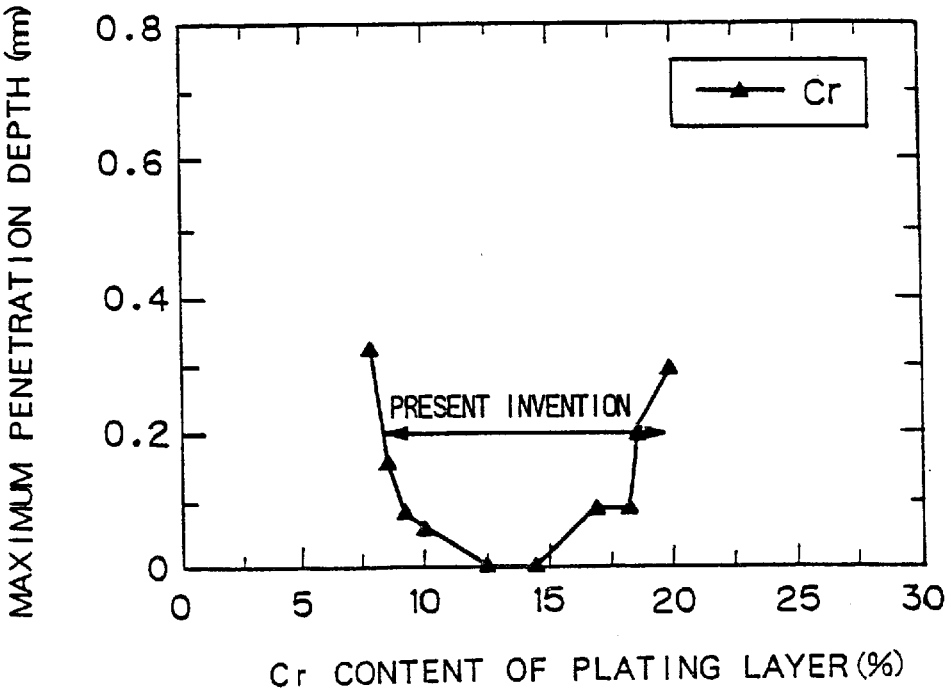

FIG. 15 is a graph showing the effect of the amount of electrodeposition layer on cosmetic corrosion resistance.

Conditions

X content of plating layer: Ni: 12%, Co: 0.3%, Mn: 34%, Cr: 13%,

X/(X+Zn) in the uppermost surface layer: Ni: 6 at %, Co: 0.4 at %, Mn: 50 at %, Cr: 17.5 at %

Chromate amount: 50±5 mg/m$^2$ $SiO_2$/Cr ratio in chromate film: 2.0±0.1 (Dry $SiO_2$)

FIG. 16*a* through FIG. 16*d*

FIG. 16*a* through FIG. 16*d* are graphs showing the effect of the content of X on cosmetic corrosion resistance.

Conditions

Amount of the plating layer: 20±2 g/m$^2$

X/(X+Zn) in the uppermost surface layer: Ni: 6 at %, Co: 0.4 at %, Mn: 50 at %, Cr: 17.5 at %

Chromate amount: 50±5 mg/m$^2$ $SiO_2$/Cr ratio in chromate film: 2.0±0.1 (Dry $Si6_2$)

Figure 17A:
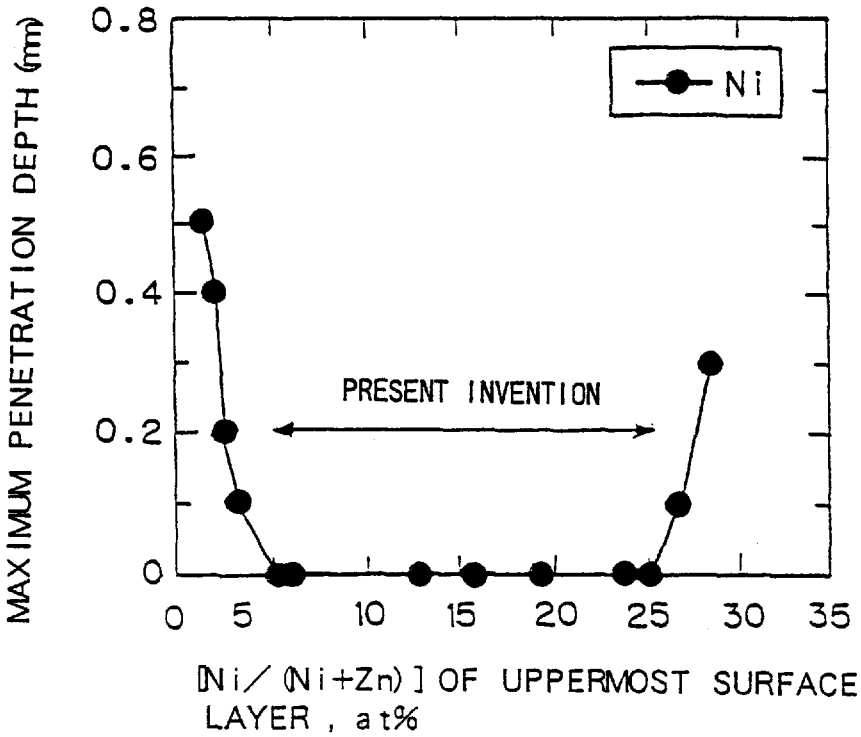
FIG. 17*a* through FIG. 17*d* are graphs showing the effect of the content of X in the uppermost surface layer, i.e., X/(X+Zn) atomic percentage, on cosmetic corrosion resistance.
Figure 17B:
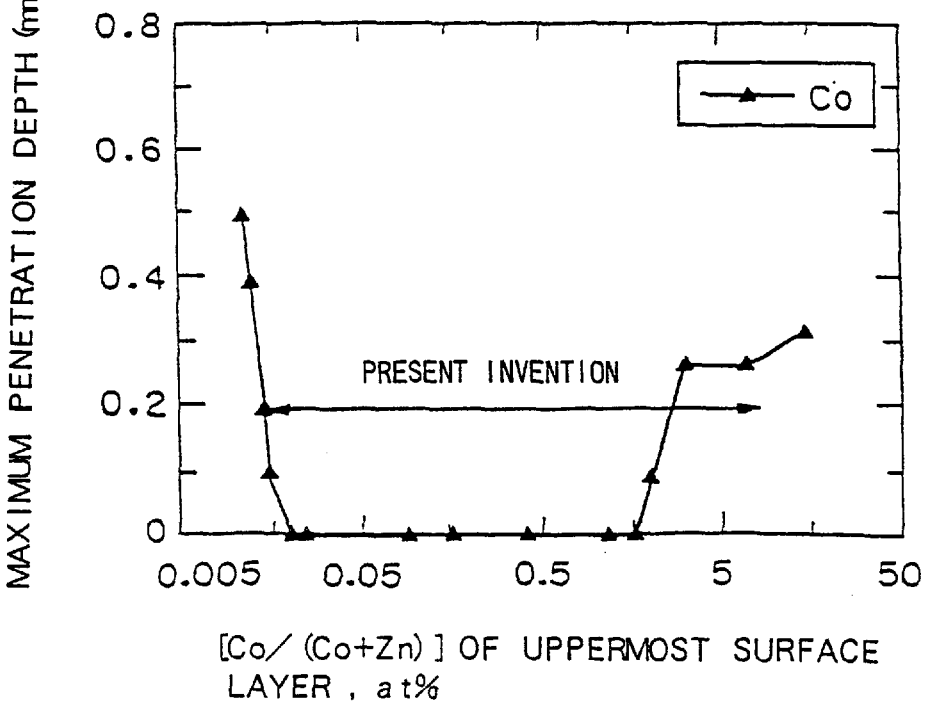
Figure 17C:
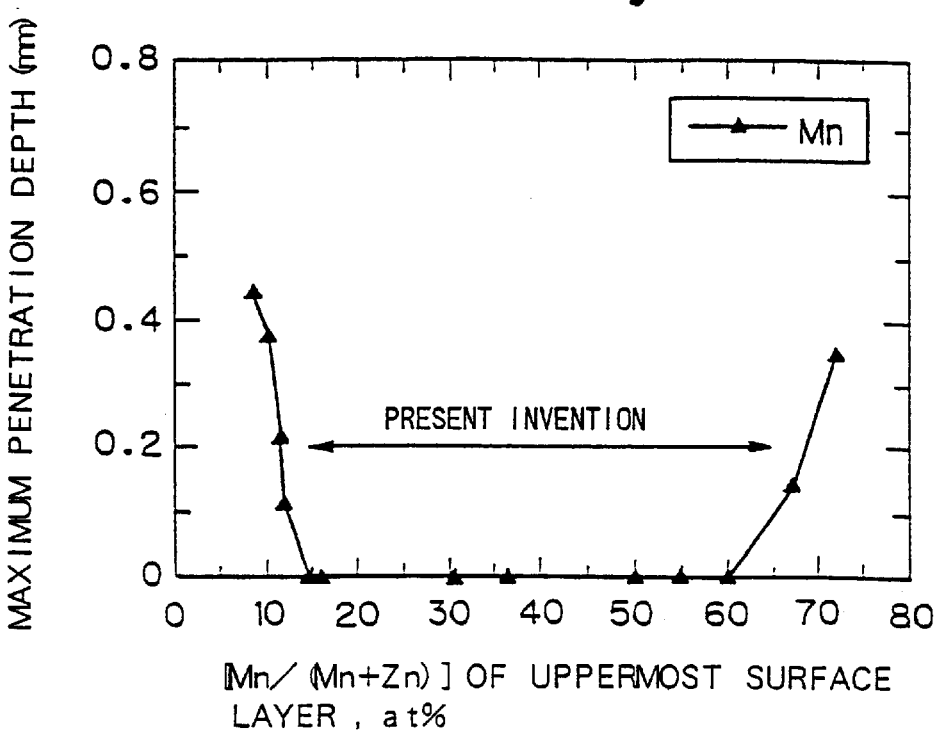
Figure 17D:
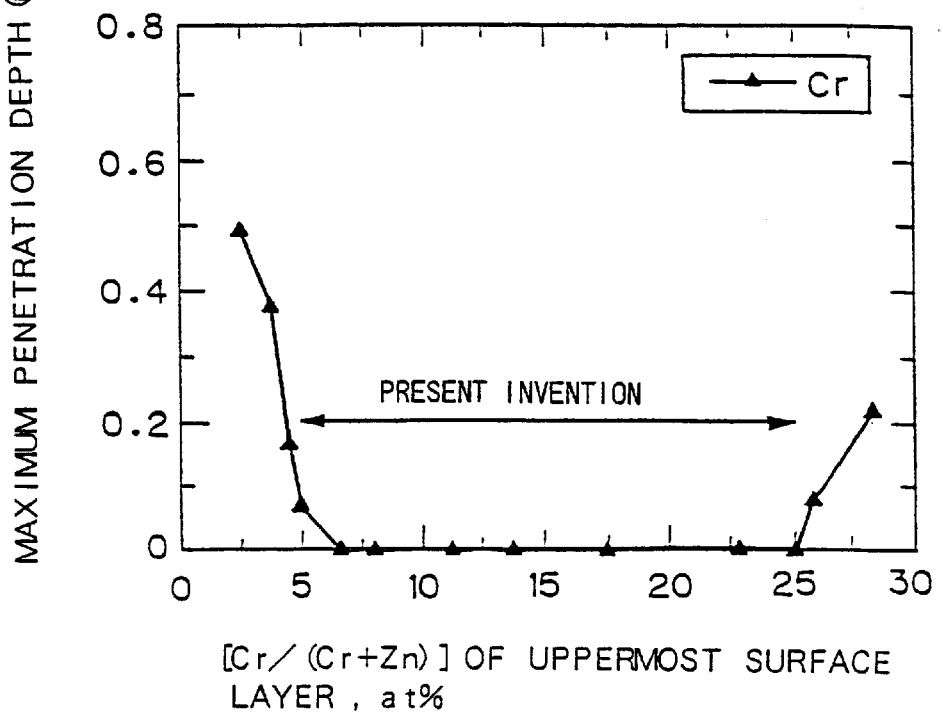

FIG. 17*a* and FIG. 17*d*

FIG. 17*a* and FIG. 17*d* are graphs showing the effect of the X content of X/(X+Zn) atomic percentage in the uppermost surface layer on cosmetic corrosion resistance.

Conditions

Amount of the plating layer: 20±2 g/m$^2$

X content of plating layer: Ni: 12%, Co: 0.3%, Mn: 34%, Cr: 13%,

Chromate amount: 50±5 mg/m$^2$ $SiO_2$/Cr ratio in chromate film: 2.0±0.1 (Dry $SiO_2$)

FIG. 18

Figure 18:
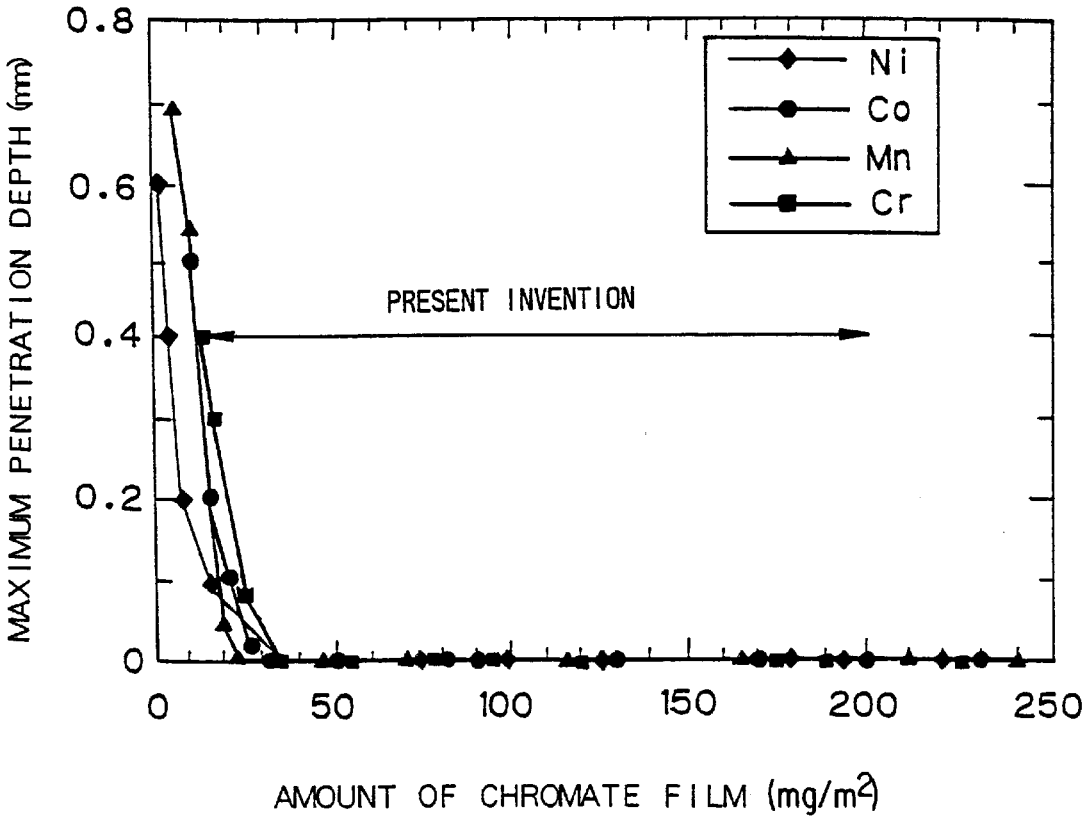
FIG. 18 is a graph showing the effect of the amount of a chromate film on cosmetic corrosion resistance.

FIG. 18 is a graph showing the effect of the amount of a chromate film on cosmetic corrosion resistance.

Conditions

Amount of the plating layer: 20±2 g/m$^2$

X content of plating layer: Ni: 12%, Co: 0.3%, Mn: 34%, Cr: 13%,

X/(X+Zn) in the uppermost surface layer: Ni: 6 at %, Co: 0.4 at %, Mn: 50 at %, Cr: 17.5 at %

$SiO_2$/Cr ratio in chromate film: 2.0±0.1 (Dry $SiO_2$)

FIG. 19

Figure 19:
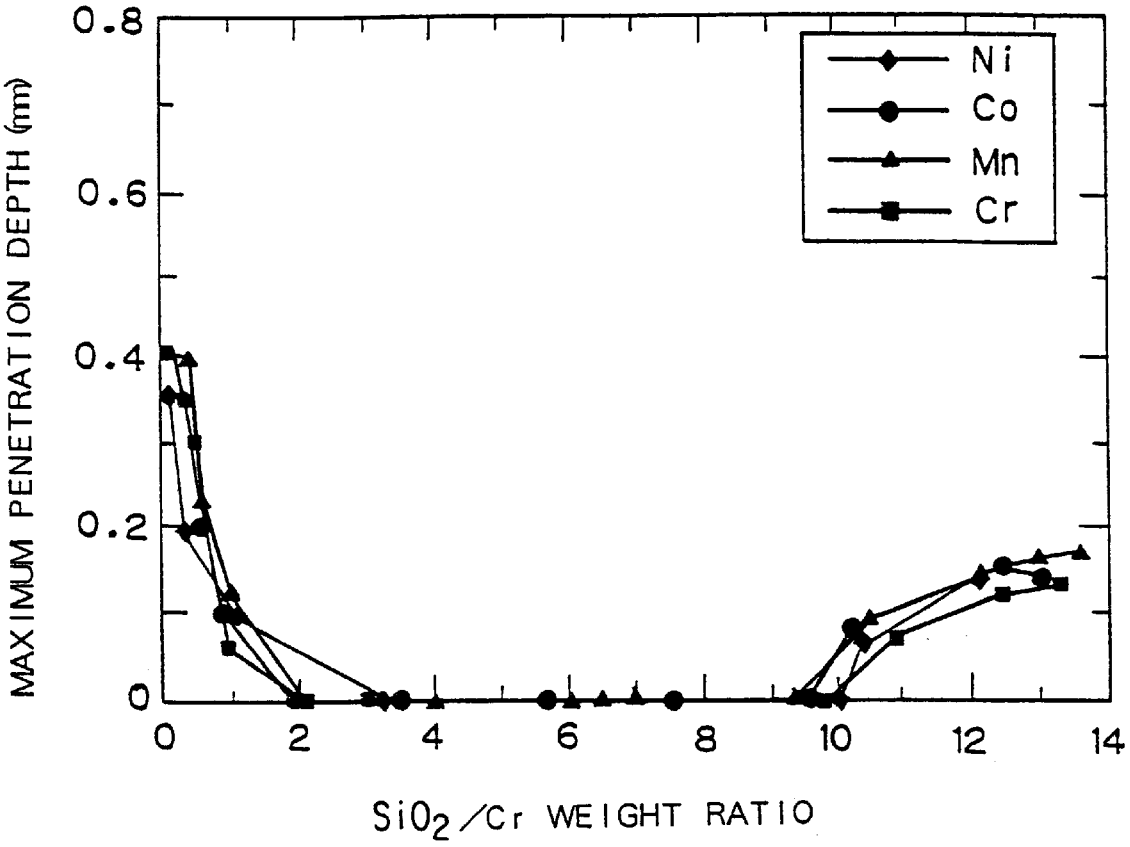
FIG. 19 is a graph showing the effect of the amount of silica contained in the chromate film, i.e., $SiO_2$/Cr weight ratio, on cosmetic corrosion resistance.

FIG. 19 is a graph showing the effect of the $SiO_2$/Cr weight ratio in the chromate film on cosmetic corrosion resistance.

Conditions

Amount of the plating layer: 20±2 g/m$^2$

X content of plating layer: Ni: 12%, Co: 0.3%, Mn: 34%, Cr: 13%.

X/(X+Zn) in the uppermost surface layer: Ni: 6 at %, Co: 0.4 at %, Mn: 50 at %, Cr: 17.5 at %

Chromate amount: 50±5 mg/m$^2$

It is apparent from FIGS. 10 through 19 that cosmetic corrosion resistance is excellent (maximum depth of penetration is less than 0.4 mm, preferably less than 0.2 mm) when the amount of Zn—X alloy plating layer is 5–40 g/m$^2$, and the X content on the average over the plating layer is: Ni: 9–18%, Co: 0.02–3%, Mn: 25–45%, Cr: 8–20%, and that the fuel corrosion resistance on the inner side is excellent when the X content in the uppermost surface layer of the Zn—X alloy plating layer is Ni: 5–25 at %, Co: 0.009–10 at %, Mn: 15–65 at %, Cr: 5–25 at % and the amount of the chromate film is 10 mg/m$^2$ or more on a metallic Cr basis. Furthermore, the presence of such an X content in the uppermost surface layer and the amount of the chromate film on the outer side also has an effect on cosmetic corrosion resistance.

Example 3

In this example, Example 2 was repeated. For comparison the case in which etching was not carried out after completing plating is also shown. It is apparent from the results shown in the Table below that criticality of $X_1 \neq X_2$ can be confirmed. It is not completely clear why fuel corrosion resistance can be improved in accordance with the present invention, but it is supposed that Ni or Zn which are resistant to corrosion is concentrated in the uppermost layer, resulting in improvement in corrosion resistance.

| | | Comparative | | | Present Invention | | | | | | | |
|---|---|---|---|---|---|---|---|---|---|---|---|---|
| | | 1 | 2 | 3 | 1 | 2 | 3 | 4 | 5 | 6 | 7 | 8 |
| $X_1$: Ni at % | | 9 | 12 | 18 | 11 | 11 | 14 | 14 | 16 | 16 | 9 | 18 |
| $X_2$: Ni at % in the uppermost surface layer (determined by ESCA) | | 9 | 12 | 18 | 8 | 13 | 10 | 17 | 13 | 18 | 5 | 25 |
| Fuel corrosion | Gasolin | X | Δ | X | ◎ | ◎ | ◎ | ◎ | ○ | ○ | ○ | ○ |
| | Gasohol M15 | X | Δ | X | ◎ | ◎ | ◎ | ◎ | ○ | ○ | ○ | ○ |
| | Gasohol M85 | X | Δ | X | ◎ | ◎ | ◎ | ◎ | ○ | ○ | ○ | ○ |

NOTE: Fuel corrosion resistance was evaluated in terms of maximum penetoration depth (Pm) as follows:

◎: Pm < 0.1 mm

○: 0.1 mm ≦ Pm < 0.2 mm

Δ: 0.2 mm ≦ Pm < 0.5 mm

X: 0.5 mm ≦ Pm

Industrial Applicability

A surface-treated steel sheet for fuel tanks of the present invention can exhibit improved fuel resistance to not only gasoline but alcohol-containing fuels such as gasohol, and the surface-treated steel sheet can be manufactured with a conventional Zn—X alloy electrodepositing apparatus efficiently and economically. Furthermore, since the steel sheet is free from Pb which is harmful to the human body, the surface-treated steel sheet of the present invention does not cause a health problem.

We claim:

1. A surface-treated steel sheet for use in manufacturing fuel tanks comprising a Zn—X plating layer on both sides of a steel sheet wherein X is Ni, Co, Mn or Cr and a chromate film placed on at least one side of said Zn—X alloy plated steel sheet, in which each Zn—X alloy plating layer has an X content for the plating metal as a whole of Ni: 9–18 wt %, Co: 0.02–3 wt %, Mn: 25–45 wt %, or Cr: 8–20 wt %, the amount of deposition of each plating layer is 5–40 g/m$^2$, the amount of Cr in the chromate film is 10–200 mg/m$^2$, at least one Zn—X alloy plattng layer has cracks in a surface layer thereof, with the density of the cracks being 1000–150000 in terms of the number of plated regions surrounded by cracks in a visual field of 1 mm×1 mm, and the maximum width of the cracks is not more than 0.5 μm, the chromate film penetrating the cracks in the at least one Zn—X alloy plating layer in contact therewith.

2. A surface-treated steel sheet for use in manufacturing fuel tanks comprising a Zn—X alloy plating layer on both sides of a steel sheet wherein X is Ni, Co, Mn or Cr and a chromate film placed on at least one side of said Zn—X alloy plated steel sheet, in which each Zn—X alloy plating layer has an X content for the plating metal as a whole of Ni: 9–18 wt %, Co: 0.02–3 wt %, Mn: 25–45 wt %, or Cr: 8–20 wt %, the amount of deposition of each plating layer is 5–40 $g/m^2$, the amount of Cr in the chromate film is 10–200 $mg/m^2$, the uppermost surface layer of each Zn—X alloy plating layer has an X/(X+Zn) atomic percentage ($X_2$) determined by surface analysis based on ESCA with $X_1 \neq X_2$ (wherein $X_1$=average value of the X content of the plating metal as a whole), and with $X_2$ being Ni: 5–25 at %, Co: 0.009–10 at %, Mn: 15–65 at % or Cr: 5–25 at %, at least one Zn—X alloy plating layer has cracks in a surface thereof, with the density of cracks being at least 1000 in terms of the number of plate regions surrounded by cracks in a visual field of 1 mm×1 mm, the chromate film penetrating the cracks in the at least one Zn—X alloy plating layer in contact therewith.

3. A surface-treated steel sheet as set forth in claim 1, wherein the Zn—X alloy is a Zn—Ni alloy and the Ni content thereof is 10–14%.

4. A surface-treated steel sheet as set forth in claim 3, wherein the Ni content is 11–13%.

5. A surface-treated steel sheet as set forth in claim 1, wherein the amount of deposition of each plating layer is 7–30 $g/m^2$.

6. A surface-treated steel sheet as set forth in claim 5, wherein the amount of deposition of each plating layer is 10–25 $g/m^2$.

7. A surface-treated steel sheet as set forth in claim 1, wherein the amount of the chromate film is 50–180 $mg/m^2$.

8. A surface-treated steel sheet as set forth in claim 1, wherein the chromate film contains silica with a ratio of $SiO_2$/Cr in weight being 1.0–10.0.

9. A surface-treated steel sheet as set forth in claim 8, wherein the ratio of $SiO_2$/Cr in weight is 1.5–9.5.

10. A surface-treated steel sheet as set forth in claim 1, wherein the density of the cracks is 1000 –50000.

11. A surface-treated steel sheet as set forth in claim 2, wherein the Zn—X alloy is a Zn—Ni alloy and the Ni content thereof is 10–14%.

12. A surface-treated steel sheet as set forth in claim 11, wherein the Ni content is 11–13%.

13. A surface-treated steel sheet as set forth in claim 2, wherein the amount of deposition of each plating layer is 7–30 $g/m^2$.

14. A surface-treated steel sheet as set forth in claim 13, wherein the amount of deposition of each plating layer is 10–25 $g/m^2$.

15. A surface-treated steel sheet as set forth in claim 2, wherein the amount of the chromate film is 50–180 $mg/m^2$.

16. A surface-treated steel sheet as set forth in claim 2, wherein the chromate film contains silica with a ratio of $SiO_2$/Cr in weight being 1.0–10.0.

17. A surface-treated steel sheet as set forth in claim 16, wherein the ratio of $SiO_2$/Cr in weight is 1.5–9.5.

18. A surface-treated steel sheet as set forth in claim 2, wherein the density of the cracks is 1000–50000.

19. A surface-treated steel sheet as set forth in claim 1, wherein $Cr^{+6}$ in the chromate film is 5% or less with respect to the total Cr content in the chromate film.

20. A surface-treated steel sheet as set forth in claim 2, wherein $Cr^{+6}$ in the chromate film is 5% or less with respect to the total Cr content in the chromate film.

21. A surface-treated steel sheet as set forth in claim 1, wherein the chromate film is an innermost layer on the steel sheet and the chromate film forms an inner surface of a fuel tank wherein fuel contacts the chromate film.

22. A surface-treated steel sheet as set forth in claim 2, wherein the chromate film is an innermost layer on the steel sheet and the chromate film forms an inner surface of a fuel tank wherein fuel contacts the chromate film.

23. A surface-treated steel sheet for use in manufacturing fuel tanks comprising a Zn—X plating layer on both sides of a steel sheet wherein X is Ni, Co, Mn or Cr and a chromate film in contact with at least one of said Zn—X alloy plating layers, in which each Zn—X alloy plating layer has an X content for the plating metal as a whole of Ni: 9–18 wt %, Co: 0.02–3 wt %, Mn: 25–45 wt %, or Cr: 8–20 wt %, the amount of deposition of each plating layer is 5–40 $g/m^2$, the amount of Cr in the chromate film is 10–200 $mg/m^2$, at least one Zn—X alloy plating layer has cracks in a surface layer thereof, with the density of the cracks being at least 1000 in terms of the number of plated regions surrounded by cracks in a visual field of 1 mm×1 mm, the chromate film penetrating the cracks in the at least one Zn—X alloy plating layer in contact therewith.

24. A surface-treated steel sheet for use in manufacturing fuel tanks comprising a Zn—X alloy plating layer on both sides of a steel sheet wherein X is Ni, Co, Mn or Cr and a chromate film in contact with at least one of said Zn—X alloy plating layers, in which each Zn—X alloy plating layer has an X content for the plating metal as a whole of Ni: 9–18 wt %, Co: 0.02–3 wt %, Mn: 25–45 wt %, or Cr: 8–20 wt %, the amount of deposition of each plating layer is 5–40 $g/m^2$, the amount of Cr in the chromate film is 10–200 $mg/m^2$, the uppermost surface layer of each Zn—X alloy plating layer has an X/(X+Zn) atomic percentage ($X_2$) determined by surface analysis based on ESCA with $X_1 \neq X_2$ (wherein $X_1$=average value of the X content of the plating metal as a whole), and with $X_2$ being Ni: 5–25 at %, Co: 0.009–10 at %, Mn: 15–65 at % or Cr: 5–25 at %, at least one Zn—X alloy plating layer has cracks in a surface thereof with the density of cracks being at least 1000 in terms of the number of plated regions surrounded by cracks in a visual field of 1 mm×1 mm the chromate film penetrating the cracks in the at least one Zn—X alloy plating layer in contact therewith.

* * * * *